US007976134B2

(12) United States Patent
Fujishiro

(10) Patent No.: US 7,976,134 B2
(45) Date of Patent: Jul. 12, 2011

(54) METHOD OF MANUFACTURING LIQUID EJECTING HEAD, LIQUID EJECTING HEAD AND LIQUID EJECTING APPARATUS

(75) Inventor: Takeshi Fujishiro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 75 days.

(21) Appl. No.: 12/397,178

(22) Filed: Mar. 3, 2009

(65) Prior Publication Data

US 2009/0225137 A1 Sep. 10, 2009

(30) Foreign Application Priority Data

Mar. 10, 2008 (JP) ..... 2008-060321
Oct. 21, 2008 (JP) ..... 2008-271390

(51) Int. Cl.
*B41J 2/045* (2006.01)

(52) U.S. Cl. ..... 347/68

(58) Field of Classification Search ..... 347/68, 347/69–72; 400/124.14, 124.16; 310/311, 310/324, 327, 358, 365; 427/100; 204/192; 29/25.35

See application file for complete search history.

(56) References Cited

U.S. PATENT DOCUMENTS 5,444,471 A * 8/1995 Usui et al. ..... 347/72

FOREIGN PATENT DOCUMENTS

JP 2004-074740 3/2004

* cited by examiner

*Primary Examiner* — K. Feggins
(74) *Attorney, Agent, or Firm* — Kilpatrick Townsend & Stockton LLP

(57) ABSTRACT

A method of manufacturing a liquid ejecting head includes: inserting a piezoelectric element unit into a storage portion of a case head while causing a fixed substrate to be struck to an inner surface of the storage portion of the case head by a magnetic force; and joining the piezoelectric element unit and the case head in a state of bringing at least part of side surfaces of the piezoelectric element unit into abutment with an alignment surface of the inner surface of the storage portion.

15 Claims, 12 Drawing Sheets

METHOD OF MANUFACTURING LIQUID EJECTING HEAD, LIQUID EJECTING HEAD AND LIQUID EJECTING APPARATUS

BACKGROUND

1. Technical Field

The present invention relates to a method of manufacturing a liquid ejecting head configured to eject liquid from nozzle openings, a liquid ejecting head, and a liquid ejecting apparatus and, more specifically, to a method of manufacturing an ink jet printhead configured to discharge ink as liquid, an ink jet printhead, and an ink-jet printing apparatus.

2. Related Art

As a known representative example of the liquid ejecting head, for example, there is an ink jet printhead configured to discharge ink drops from nozzle openings using a pressure generated by a displacement of a piezoelectric element. More specifically, an ejecting head including a flow channel unit having a flow channel formed panel provided with pressure generating chambers which are in communication with nozzle openings and a diaphragm provided on the side of one of the surface thereof, piezoelectric elements (piezoelectric transducers) provided corresponding to the respective pressure generating chambers and fixed to a fixed substrate, and a case head (structure) having a storage portion for fixing the fixed substrate is known (see JP-A-2004-74740).

However, since the case head is fixed to the flow channel unit, if the positional accuracy of fixation of the fixed substrate to the case head is low, the positioning accuracy of the piezoelectric elements with respect to the pressure generating chambers is lowered, so that there arises a problem that desired ink discharging characteristics cannot be obtained.

In order to position the case head and the fixed substrate with a high degree of accuracy, a clearance between a storage portion of the case head and the fixed substrate must be controlled with a high degree of accuracy. Therefore, manufacture of the case head with a high degree of accuracy is required, so that there arise problems such that the manufacturing process is complicated, and that the manufacturing cost is increased.

In order to control the clearance between the case head and the fixed substrate with a high degree of accuracy, dimensional variations of the case head due to the temperature or the moisture must be followed. Therefore, a temperature control and a moisture control are required, so that there arise problems such that the manufacturing process is complicated, and that the manufacturing cost is increased.

Furthermore, in order to position the case head and the fixed substrate with a high degree of accuracy, a large scale of alignment apparatus might be required, so that there arise problems such that the manufacturing process is complicated, and that the manufacturing cost is increased.

In particular, in the ink jet printhead being elongated by increase in number of the nozzle openings, the length of the fixed substrate in the direction of parallel arrangement of the piezoelectric elements is also increased. Consequently, the longitudinal length of the storage portion of the case head is increased, and hence the control of the clearance between the fixed substrate and the storage portion becomes difficult.

Also, when bonding the flow channel unit to the case head and bonding a piezoelectric element unit to the case head and the flow channel unit, a state of being pressurized to each other must be maintained by a jig, and hence a plurality of jigs are needed when manufacturing a plurality of ink jet printheads, so that there arises a problem of increase in manufacturing cost.

Such problems as described above are not limited to the method of manufacturing the ink jet printhead, but exist also for the liquid ejecting head which ejects liquid other than ink.

SUMMARY

An advantage of some aspects of the invention is to provide a liquid ejecting head in which cost reduction is achieved by simplifying the manufacturing method thereof and liquid ejecting characteristics are improved, a method of manufacturing the same, and a liquid ejecting apparatus.

In order to solve the problems described above, there is provided a method of manufacturing a liquid ejecting head, at least part of an area of which coming into abutment with a storage portion of a fixed substrate is formed of a magnetic material. The liquid ejecting head includes a flow channel unit having pressure generating chambers which is in communication with nozzle openings for ejecting liquid, a piezoelectric element unit including a piezoelectric element formed member provided in an area opposing the pressure generating chamber of the flow channel unit and formed with a plurality of piezoelectric elements and a fixed substrate configured to fix the piezoelectric element formed member thereto, and a case head being fixed to the flow channel unit and having the storage portion, the fixed substrate of the piezoelectric element unit being joined to an inner surface of the storage portion. The method includes inserting the piezoelectric element unit into the storage portion of the case head while causing the fixed substrate to be attracted to an inner surface of the storage portion of the case head by a magnetic force; and joining the piezoelectric element unit and the case head in a state of bringing at least part of side surfaces of the piezoelectric element unit into abutment with an alignment surface of the inner surface of the storage portion.

In this configuration, by causing the fixed substrate and the case head to be attracted to each other by the magnetic force and causing the at least part of the side surface of the piezoelectric element unit to come into abutment with and be fixed to the alignment surface of the inner surface of the storage portion of the case head, highly accurate positioning of a diaphragm and the piezoelectric element via the alignment surface is achieved. Accordingly, the manufacturing process is simplified and hence the cost reduction is achieved and, simultaneously, the case head does not require a highly accurate dimensional allowance, so that the case head is manufactured easily at a low cost.

Preferably, the piezoelectric element of the piezoelectric element unit is brought into abutment with the alignment surface. Accordingly, highly accurate positioning of the piezoelectric element and the diaphragm via the alignment surface is achieved.

Preferably, the magnetic force is generated by a magnet arranged outside the case head. In this configuration, the structure of the case head or the like does not have to be changed and hence reduction of the manufacturing cost is achieved.

Preferably, the method includes: providing an alignment magnet on the side of the alignment surface of the storage portion of the case head and a fixing magnet on the case head on a side opposite from the alignment surface, the alignment magnet and the fixing magnet being provided so that a magnetic field of the alignment magnet with respect to the fixed substrate is larger than a magnetic field of the fixing magnet with respect to the fixed substrate; inserting the piezoelectric element unit into the storage portion of the case head having the flow channel unit fixed thereto while causing the fixed substrate to be attracted to the inner surface of the storage portion of the case head by the magnetic force; bringing the at least part of the side surfaces of the piezoelectric element unit into abutment with the alignment surface; and bonding the piezoelectric element to the flow channel unit and joining the piezoelectric element unit and the case head in a state in which the piezoelectric element unit is pressed toward the flow channel unit by the magnetic forces of the alignment magnet and the fixing magnet. Accordingly, by causing the fixed substrate and the case head to be attracted to each other by the magnetic force and causing the at least part of the side surface of the piezoelectric element unit to come into abutment with and be fixed to the alignment surface of the inner surface of the storage portion of the case head, highly accurate positioning of the diaphragm and the piezoelectric element via the alignment surface is achieved. Accordingly, the manufacturing process is simplified and hence the cost reduction is achieved and, simultaneously, the case head does not require a highly accurate dimensional allowance, so that the case head is manufactured easily at a low cost. By providing the alignment magnet and the fixing magnet, the fixed substrate can be urged toward the flow channel unit by the magnetic forces, and hence a jig or the like for urging the piezoelectric element unit when the piezoelectric element unit is adhered to the flow channel unit is no longer necessary, so that the cost reduction is achieved.

Preferably, the alignment surface is an inner surface of the storage portion on one side in the direction of parallel arrangement of the pressure generating chambers, and the surface of the piezoelectric element unit which comes into abutment with the alignment surface is a side surface of the piezoelectric element on one side in the direction of parallel arrangement of the plurality of piezoelectric elements. Accordingly, highly accurate positioning between the direction of parallel arrangement (short side direction) of the piezoelectric elements and the diaphragm which is specifically required to be highly accurate is achieved, and improvement of the liquid ejecting characteristics is achieved.

The invention provides a liquid ejecting head including: a flow channel unit having pressure generating chambers which are in communication with nozzle openings for ejecting liquid; a piezoelectric element unit including a piezoelectric element formed member provided in an area opposing the pressure generating chamber of the flow channel unit and formed with a plurality of piezoelectric elements and a fixed substrate configured to fix the piezoelectric element formed member thereto; and a case head being fixed to the flow channel unit and having a storage portion, the fixed substrate of the piezoelectric element unit being joined to an inner surface of the storage portion, wherein the piezoelectric element unit and the case head are fixed in a state in which at least part of side surfaces of the piezoelectric element unit is in abutment with an alignment surface of an inner surface of the storage portion of the case head, and at least the side of the alignment surface of the fixed substrate is formed of a magnetic material.

In this configuration, since the piezoelectric element unit is fixed in a state of being in abutment with the alignment surface of the case head, a diaphragm and the piezoelectric elements are fixed in a state of being positioned with a high degree of accuracy. Therefore, improvement of the liquid ejecting characteristics is achieved and the elongation of the liquid ejecting head is realized.

Preferably, the case head includes an alignment magnet on the side of the alignment surface thereof. In this configuration, by the provision of the alignment magnet on the case head, occurrence of displacement is reliably prevented when joining the case head and the fixed substrate and when joining the piezoelectric elements and the diaphragm, so that the liquid ejecting head in which the piezoelectric elements and the diaphragm are positioned with a high degree of accuracy is realized.

Preferably, the case head includes a fixing magnet on the side opposite from the alignment surface. In this arrangement, since fixation is achieved by causing the fixed substrate and the case head to be attracted to each other by the alignment magnet and causing the at least part of the side surface of the piezoelectric element unit to come into abutment with the alignment surface of the inner surface of the storage portion of the case head, fixation in a state in which the diaphragm and the piezoelectric element are positioned with a high degree of accuracy is achieved. Therefore, improvement of the liquid ejecting characteristics is achieved and the elongation of the liquid ejecting head is realized. By providing the alignment magnet and the fixing magnet, the fixed substrate can be urged toward the flow channel unit by magnetic forces, and hence a jig or the like for urging the piezoelectric element unit when bonding the piezoelectric element unit to the flow channel unit is no longer necessary, so that the cost reduction is achieved.

Preferably, the alignment magnet and the fixing magnet being provided so that a magnetic field of the alignment magnet with respect to the fixed substrate is larger than a magnetic field of the fixing magnet with respect to the fixed substrate. Accordingly, the fixed substrate can be struck to the case head reliably by the alignment magnet.

Preferably, at least areas of the flow channel unit opposing the alignment magnet and the fixing magnet are formed of the magnetic material. In this configuration, since the bonding is achieved by causing the flow channel unit and the case head to be attracted to each other by the magnetic forces of the alignment magnet and the fixing magnet when bonding the flow channel unit and the case head, the jig or the like for urging the case head and the flow channel unit to each other is not necessary, so that the cost reduction is achieved.

Preferably, the alignment magnet is arranged so as to have different magnetic poles on the side of the alignment surface and on the side opposite from the alignment surface in the direction of alignment, and the fixing magnet is arranged so as to have magnetic poles inverted from the alignment magnet in the direction of alignment. In this configuration, the fixed substrate can reliably be struck to the case head and the fixed substrate can reliably attracted toward the flow channel unit by the magnetic forces by the alignment magnet and the fixing magnet.

Preferably, the alignment magnet and the fixing magnet are each arranged so as to have different magnetic poles on the side of the flow channel unit and on the side opposite from the flow channel unit. In this configuration, the fixed substrate can reliably be struck to the case head and the fixed substrate can reliably attracted toward the flow channel unit by the magnetic forces by the alignment magnet and the fixing magnet.

Preferably, the alignment magnet has larger outer dimensions than the fixing magnet. Preferably, the alignment magnet is provided at a position where the distance from the fixed substrate is narrower than the distance between the fixing magnet and the fixed substrate. In this configuration, the strength of the magnetic field with respect to the fixed substrate can be adjusted by the size or the distance of the magnet, and hence the piezoelectric element unit is reliably brought into abutment with the alignment surface by causing the piezoelectric element unit to be attracted by the alignment magnet.

Preferably, the alignment magnet and the fixing magnet are provided between the fixed substrate and the flow channel unit. In this configuration, the fixed substrate can be urged to the flow channel unit efficiently by the magnetic forces of the alignment magnet and the fixing magnet.

Preferably, the magnetic material of the fixed substrate is invar. In this configuration, the fixed substrate may be formed at an equivalent coefficient of linear expansion to the piezoelectric elements, so that warp of the substrate due to heat is prevented and lowering of the positional accuracy between the piezoelectric elements and the diaphragm is prevented.

Preferably, the entire fixed substrate is formed of the magnetic material. In this configuration, the fixed substrate is easily manufactured, and the cost reduction is achieved.

Preferably, the case head is integrally molded with the magnets. In this configuration, the process to bond the magnets such as the alignment magnet and the fixing magnet to the case head is not necessary, so that reduction of the manufacturing cost of the case head is achieved.

The invention also provides a liquid ejecting apparatus comprising the liquid ejecting head configured as described above. In this configuration, the liquid ejecting apparatus which is capable of fast printing is achieved by improving the liquid ejecting characteristics and increasing the number of the nozzle openings.

BRIEF DESCRIPTION OF THE DRAWINGS

The invention will be described with reference to accompanying drawings, wherein like numbers reference like elements.

DESCRIPTION OF EXEMPLARY EMBODIMENTS

The invention will be described in detail on the basis of embodiments.

First Embodiment

Figure 1:
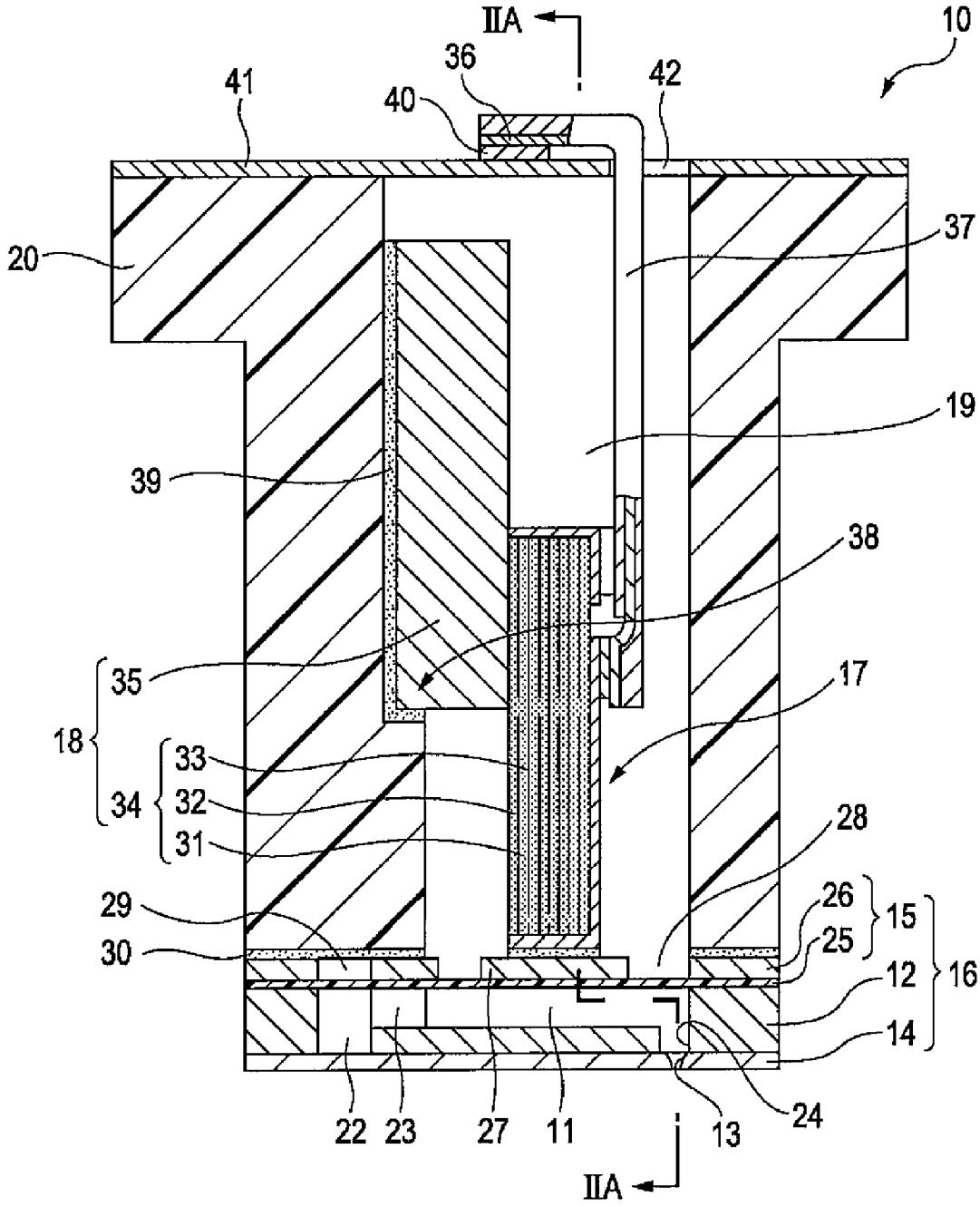
FIG. 1 is a cross-sectional view of a printhead according to a first embodiment of the invention.
Figure 2A:
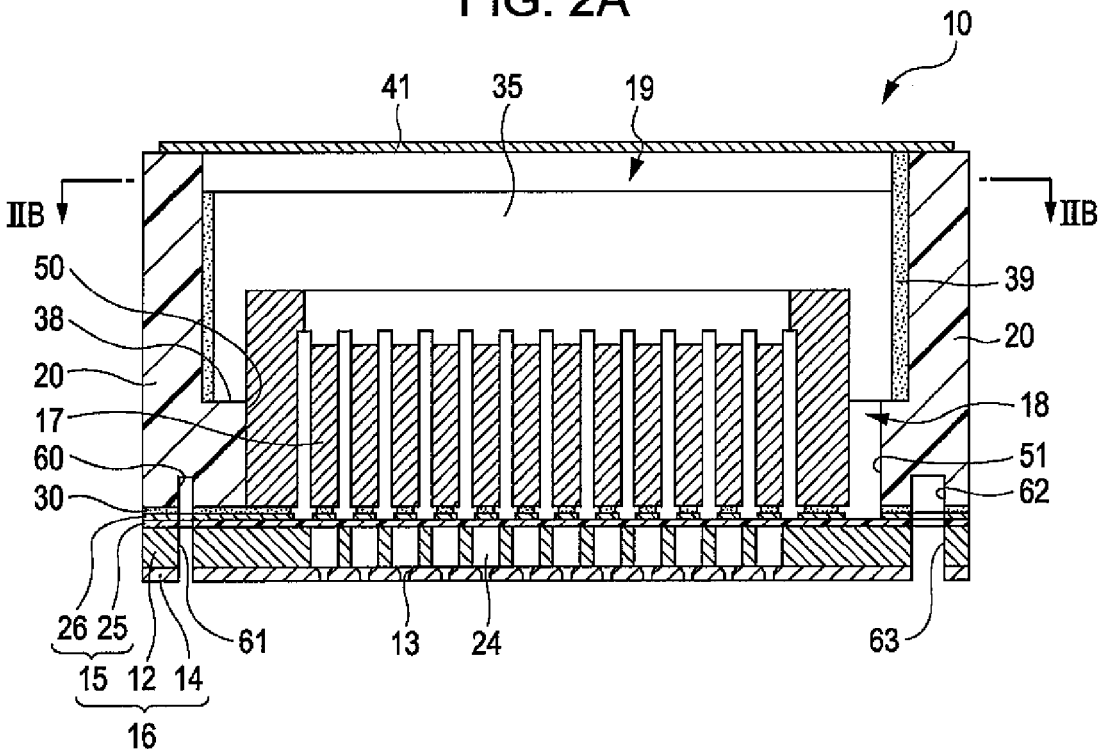
FIGS. 2A and 2B are cross-sectional views of the printhead according to the first embodiment of the invention.
Figure 2B:
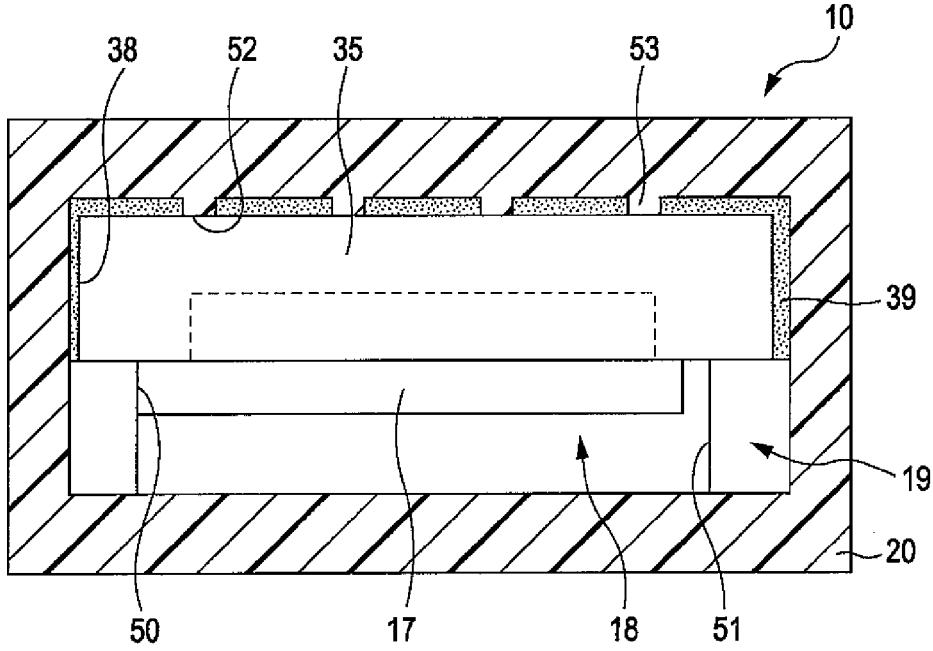

FIG. 1 is a cross-sectional view of a pressure generating chamber of an ink jet printhead as an example of a liquid ejecting head according to a first embodiment of the invention taken along the short side direction, FIG. 2A is a cross-sectional view taken along the line IIA-IIA in FIG. 1, and FIG. 2B is a cross-sectional view of FIG. 2A taken along the line IIB-IIB.

As shown in the drawings, an ink jet printhead 10 includes a flow channel unit 16 having a flow channel formed substrate 12 having a plurality of pressure generating chambers 11, a nozzle plate 14 formed with a plurality of nozzle openings 13 which are in communication with the respective pressure generating chambers 11, and a diaphragm 15 provided on a surface of the flow channel formed substrate 12 opposite from the nozzle plate 14. In addition, it includes a piezoelectric element unit 18 having piezoelectric elements 17 provided in areas on the diaphragm 15 corresponding to the respective pressure generating chambers 11 and a case head 20 being fixed to the diaphragm 15 and having a storage portion 19 for storing the piezoelectric element unit 18.

The flow channel formed substrate 12 is provided with the plurality of pressure generating chambers 11 partitioned by partitioning walls and arranged on a surface layer portion on one of the surfaces thereof in parallel in the widthwise direction thereof. Provided outside the row of the respective pressure generating chambers 11 so as to penetrate through the flow channel formed substrate 12 in the direction of the thickness thereof is a reservoir 22 which receives a supply of ink via an ink introduction channel (not shown) as a liquid introduction channel of the case head 20. The reservoir 22 and the respective pressure generating chambers 11 are in communication with each other via ink supply channels 23, and the respective pressure generating chambers 11 receive a supply of ink via an ink introduction channel 21, the reservoir 22, and the ink supply channels 23. The ink supply channels 23 are formed to have a width narrower than the pressure generating chambers 11 in the first embodiment, so that the flow channel resistance with respect to the ink flowing from the reservoir 22 into the pressure generating chambers 11 is maintained at a constant value. Also, nozzle communication holes 24 which are penetrated through the flow channel formed substrate 12 are formed on the opposite end side of the pressure generating chambers 11 from the reservoir 22. In other words, in the first embodiment, the pressure generating chambers 11, the reservoir 22, the ink supply channel 23, and the nozzle communication holes 24 are provided on the flow channel formed substrate 12 as the liquid flow channels. The flow channel formed substrate 12 as described above is formed of silicon monocrystal substrate, and the pressure generating chambers 11 or the like provided on the flow channel formed substrate 12 are formed by etching the flow channel formed substrate 12.

The nozzle plate 14 formed with the nozzle openings 13 is joined to the flow channel formed substrate 12 on one of the surfaces thereof, and the nozzle openings 13 are in communication with the pressure generating chambers 11 respectively via the nozzle communication holes 24 formed on the flow channel formed substrate 12.

The diaphragm 15 is joined to the other surface of the flow channel formed substrate 12, that is, on the side of the pressure generating chambers 11 where the openings are formed, and the respective pressure generating chambers 11 are sealed by the diaphragm 15.

The diaphragm 15 is formed of a composite panel including an elastic film 25 formed of, for example, a resilient member such as a resin film, and a supporting panel 26 formed of a metal material or the like for example for supporting the elastic film 25, and the side of the elastic film 25 is joined to the flow channel formed substrate 12. For example, in the first embodiment, the elastic film 25 is formed of a PPS (polyphenylene sulfide) having a thickness of about several micrometers and the supporting panel 26 is formed of a stainless steel plate (SUS) having a thickness of about several tens micrometers. In the areas of the diaphragm 15 opposing the respective pressure generating chambers 11, island portions 27 with which distal end portions of the piezoelectric element 17 come into abutment are provided. Distal end surfaces of the piezoelectric element 17 are joined to the island portions 27 via an adhesive agent 30. In other words, thinned portions 28 having a thickness smaller than other areas are formed in areas opposing peripheral edges of the respective pressure generating chambers 11 of the diaphragm 15, and the island portions 27 are formed inside the thinned portions 28, respectively. In the first embodiment, a compliance portion 29 which is formed by removing part of the supporting panel 26 by etching like the thinned portions 28 and composed substantially only of a resilient film is provided in an area of the diaphragm 15 opposing the reservoir 22. The compliance portion 29 serves to absorb a pressure change by deformation of the elastic film 25 of the compliance portion 29 when the pressure change is occurred in the reservoir 22 and maintain the pressure in the reservoir 22 at a constant value.

Here, the piezoelectric elements 17 which are pressure generating means configured to generate a pressure for discharging ink drops in the pressure generating chambers 11 will be described. In the first embodiment, the piezoelectric elements 17 are formed integrally in the single piezoelectric element unit 18. In other words, the respective piezoelectric elements 17 are formed by forming a piezoelectric element formed member 34 by laminating a piezoelectric material 31 and electrode forming materials 32 and 33 alternately vertically in a sandwich form, and cutting the piezoelectric element formed member 34 in a comb tooth shape corresponding to the respective pressure generating chambers 11. In other words, in the first embodiment, a plurality of the piezoelectric elements 17 are formed integrally. Then, an inactive area of the piezoelectric elements 17 (the piezoelectric element formed member 34) which does not contribute to vibrations, that is, the proximal sides of the piezoelectric elements 17 are secured to a fixed substrate 35, and the piezoelectric elements 17 are fixed to the case head 20 via the fixed substrate 35.

The fixed substrate 35 is formed of the magnetic material (ferromagnetic material) at least partly on the side of the surface which is brought into abutment with an alignment surface 50 which is an inner surface of the case head 20, which will be described in detail later. In the first embodiment, the manufacture is simplified by forming the entire fixed substrate 35 of the magnetic material. The fixed substrate 35 preferably has a coefficient of linear expansion equivalent to the piezoelectric elements 17 (the piezoelectric element formed member 34) and, for example, invar, which is nickel alloy composed of 40% nickel (Ni) and 60% iron (Fe) may be employed. In this manner, by using the material having the coefficient of linear expansion equivalent to that of the piezoelectric elements 17 as the fixed substrate 35, warp caused by the difference in coefficient of linear expansion due to the temperature variations is prevented. In other words, even when the adhesive agent (not shown) for bonding the fixed substrate 35 to the piezoelectric elements 17 is heat-cured, the warp of the substrate due to the difference in coefficient of linear expansion is prevented. Accordingly, when the piezoelectric element unit 18 is positioned in the case head 20 by the process of manufacture, described later in detail, lowering of the positional accuracy due to the warp is prevented, so that the precise positioning of the piezoelectric element unit 18 with respect to the case head 20 is achieved, whereby the ink discharging characteristics are improved. The coefficient of linear expansion of the invar, which is the material of the fixed substrate 35, can be changed by changing the ratio of the iron and nickel, and hence the ratio of iron and nickel may be selected as appropriate according to the coefficient of linear expansion of the piezoelectric elements 17 used. It is preferable to form the fixed substrate 35 entirely to have the coefficient of linear expansion equivalent to the piezoelectric elements 17 even when the part of the area of the fixed substrate 35 which comes into abutment with the alignment surface 50 of the case head 20 is formed of the magnetic material as a matter of course.

A flexible wiring substrate 37 configured to supply signals for driving the respective piezoelectric elements 17 is connected to the surface of the piezoelectric elements 17 near the proximal portion thereof on the opposite side of the fixed substrate 35 and, in the first embodiment, the piezoelectric elements 17 (the piezoelectric element formed member 34), the fixed substrate 35, and the flexible wiring substrate 37 constitute the piezoelectric element unit 18.

The piezoelectric element unit 18 in this manner is fixed in a state in which the distal end portions of the piezoelectric elements 17 are in abutment with the island portions 27 of the diaphragm 15 as described above. In the first embodiment, the case head 20 is fixed to the diaphragm 15 as descried above, and the piezoelectric element unit 18 is stored in the storage portion 19 of the case head 20, and the fixed substrate 35 on which the piezoelectric elements 17 are fixed is fixed to the case head 20 on the side of the opposite surface from the piezoelectric elements 17.

More specifically, the case head 20 is provided with the storage portion 19 penetrated through the area opposing the island portions 27 in the direction of the thickness thereof. Also, the storage portion 19 of the case head 20 is formed to be narrower in width on the side of the diaphragm 15 and is provided with a shoulder 38 on the inner surface thereof, and the fixed substrate 35 is joined to the inner surface of the case head 20 where the shoulder 38 is formed with the adhesive agent 39.

The case head 20 as described above is formed, for example, with a resin material. Then, the inner surface of the storage portion 19 of the case head 20 corresponds to the alignment surface 50 with which at least part of the side surface of the piezoelectric element unit 18 comes into abutment. In the first embodiment, the alignment surface 50 corresponds to one of the inner surfaces of the storage portion 19 in the direction of parallel arrangement of the pressure generating chambers 11, and the side surface of the piezoelectric element 17 on one side in the direction of parallel arrangement of the piezoelectric elements 17 is in abutment with the alignment surface 50. A plurality of the pressure generating chambers 11 are arranged in parallel in the short side direction (widthwise direction), and a plurality of the piezoelectric elements 17 are arranged in parallel in the short side direction (widthwise direction) of the end surface thereof corresponding to the plurality of the pressure generating chambers 11. In other words, the direction of parallel arrangement of the piezoelectric elements 17 corresponds to the short side direction of the end surfaces which are fixed to the island portions 27, and the short side direction of the piezoelectric elements 17 and the short side direction of the island portions 27 are positioned by bringing the side surface of the piezoelectric element 17 on the one side in the direction of parallel arrangement of the piezoelectric elements 17 into abutment with the alignment surface 50 of the case head 20. The width of the island portions 27 in the short side direction and the width of the piezoelectric elements 17 in the short side direction both have a size as small as several tens micrometers, and both are formed to have a substantially equivalent width. Therefore, the displacement of the piezoelectric elements 17 cannot be transmitted to the diaphragm 15 via the island portions 27 unless the positioning between the piezoelectric elements 17 and the island portions 27 in the short side direction is achieved with a high degree of accuracy, and deterioration of the ink discharging characteristics may be resulted. In the first embodiment, the short side direction of the piezoelectric elements 17 and the short side direction of the island portions 27 are positioned with a high degree of accuracy by bringing the alignment surface 50 of the case head 20 into abutment with the side surface of the piezoelectric element 17 on the one side in the direction of parallel arrangement of the piezoelectric elements 17 for achieving positioning, so that superior ink discharging characteristics are demonstrated.

Incidentally, the alignment surface 50 of the case head 20 is formed to be located at a highly accurate position with respect to a positioning hole 60 to which a positioning pin (not shown) for positioning the case head 20 with respect to the flow channel unit 16 is inserted, and the island portions 27 of the flow channel unit 16 are formed to be located at highly accurate positions with respect to a positioning hole 61 which is brought into communication with the positioning hole 60 of the case head 20 and is inserted with the positioning pin (not shown). Therefore, by bringing the piezoelectric elements 17 into abutment with the alignment surface 50 of the case head 20, the alignment surface 50 and the island portions 27 are positioned with a high degree of accuracy in the direction of parallel arrangement (short side direction) of the piezoelectric elements 17. The case head 20 and the flow channel unit 16 are formed with the positioning holes 60 and 61 and positioning holes 62 and 63 respectively on both sides in the direction of parallel arrangement of the pressure generating chambers 11 (the both sides of the piezoelectric elements 17 in the direction of parallel arrangement), so that the case head 20 and the flow channel unit 16 are positioned and joined by inserting a positioning pin into the positioning holes 60 and 61 and the positioning pin into the positioning holes 62 and 63. The positioning holes 60 and 61 provided on the case head 20 on the side of the alignment surface 50 are formed as simple holes, and the positioning holes 62 and 63 formed on the side opposite from the alignment surface 50 are formed into elongated holes having the longitudinal axis in the direction of parallel arrangement of the pressure generating chambers 11. Accordingly, only the positioning holes 60 and 61 must be formed to have a highly accurate dimensional accuracy with respect to the alignment surface 50 and the island portions 27 in the short side direction. In contrast, the positioning holes 62 and 63 are not positioned in the direction of parallel arrangement of the pressure generating chambers 11 and positioning in the longitudinal direction of the pressure generating chambers 11, that is, the positioning in the rotating direction about the positioning holes 60 and 61. Therefore, the positioning holes 62 and 63 do not have to be formed with a high degree of accuracy in the direction of parallel arrangement of the pressure generating chambers 11, so that reduction of the manufacturing cost of the case head 20 is achieved.

In this manner, in order to bring part of the piezoelectric element unit 18, in the first embodiment, the piezoelectric element 17 into abutment with the alignment surface 50, it is achieved by using a magnet provided outside the case head 20, which will be described later in detail. In the ink jet printhead 10 in the first embodiment, since the fixed substrate 35 which constitutes the piezoelectric element unit 18 and the case head 20 are fixed in a state in which the piezoelectric elements 17 and the island portions 27 are positioned with a high degree of accuracy via the alignment surface 50, improvement of the ink discharging characteristics is achieved. Incidentally, it is because the displacement of the piezoelectric elements 17 cannot be transmitted efficiently to the diaphragm, so that deterioration of the ink discharging characteristics is resulted if they are fixed in a state in which the piezoelectric elements 17 and the island portions 27 are in positional displacement.

A surface 51 opposing the alignment surface 50 of the storage portion 19 of the case head 20 is provided so as to define a predetermined clearance with respect to the piezoelectric element unit 18 (the side surface on the opposite side in the direction of parallel arrangement of the piezoelectric elements 17 in the first embodiment). In other words, the width of the storage portion 19 in the longitudinal direction (the direction of parallel arrangement of the piezoelectric elements 17) is provided to be wider than the width in the direction of arrangement of the piezoelectric elements 17. Then, by bringing the side surface of the piezoelectric element 17 on the one side in the direction of parallel arrangement of the piezoelectric elements 17 into abutment with the alignment surface 50, a space is defined between the surface 51 opposing the alignment surface 50 and the side surface on the other side in the direction of parallel arrangement of the piezoelectric elements 17. In this manner, the surface 51 of the storage portion 19 in which the piezoelectric elements 17 are stored is not necessary to have a highly accurate dimensional allowance in comparison with the alignment surface 50, and the case head 20 formed of the resin material may be formed with an allowance which is normal in manufacture. Therefore, the manufacture of the case head 20 is facilitated, and the cost of the case head 20 may be reduced. Even when the number of the nozzle openings 13 is increased and the length of the ink jet printhead 10 is increased, what is necessary is only to set the dimensional allowance between the positioning hole 61 and the alignment surface 50 with a high degree of accuracy when manufacturing the case head 20, and it is not necessary to form the longitudinal width of the storage portion 19 (in the direction of parallel arrangement of the piezoelectric elements 17) with a high degree of accuracy. Therefore, the length of the ink jet printhead 10 may be increased and hence the number of the nozzle openings 13 may be increased without deteriorating the ink discharging characteristics.

A predetermined clearance is provided between the fixed substrate 35 and the inner surface of the storage portion 19 of the case head 20 in a state in which the side surface of the piezoelectric element 17 on the one side in the direction of parallel arrangement of the piezoelectric elements 17 is in abutment with the alignment surface 50 of the case head 20. In other words, a space is defined between the side surface of the fixed substrate 35 on the side of the alignment surface 50 and the storage portion 19 of the case head 20. Then, the fixed substrate 35 and the inner surface of the storage portion 19 of the case head 20 where the shoulder 38 is formed are joined by the adhesive agent 39 being filled therebetween, so that the piezoelectric element unit 18 and the case head 20 are joined and fixed. As shown in FIG. 2B, provided on a surface 52 in the longitudinal direction of the piezoelectric elements 17 from among the inner surfaces of the case head 20 where the fixed substrate 35 is fixed are a plurality of projecting ribs 53, and an adhesive agent 39 is filled between the plurality of ribs 53 to join the both members.

A wiring board 41 formed with a plurality of conductive pads 40 to which wirings 36 of the flexible wiring substrate 37 are connected respectively is fixed onto the case head 20, and the storage portion 19 of the case head 20 is substantially closed by the wiring board 41. The wiring board 41 is formed with a slit-like opening 42 in an area opposing the storage portion 19 of the case head 20, and the flexible wiring substrate 37 is drawn out of the storage portion 19 from the opening 42 of the wiring board 41.

The flexible wiring substrate 37 which constitutes the piezoelectric element unit 18 includes, for example, a chip-on-film (COF) on which a drive IC (not shown) for driving the piezoelectric elements 17 is mounted in the first embodiment. Then, the respective wirings 36 of the flexible wiring substrate 37 are connected on the proximal side thereof to the electrode forming materials 32 and 33 which constitute the piezoelectric elements 17 by, for example, soldering or an anisotropic conductive material or the like. In contrast, on the distal side thereof, the respective wirings 36 are joined to the respective conductive pads 40 of the wiring board 41. Specifically, in a state in which the distal end portion of the flexible wiring substrate 37 drawn out of the storage portion 19 from the opening 42 of the wiring board 41 is bent along the surface of the wiring board 41, the respective wirings 36 are joined to the respective conductive pads 40 of the wiring board 41.

The ink jet printhead 10 as descried above is adapted to discharge ink drops from predetermined nozzle openings 13 by changing the capacities of the respective pressure generating chambers 11 by the deformation of the piezoelectric elements 17 and the diaphragm 15 when discharging the ink drops. Specifically, when ink is supplied to the reservoir 22 from an ink cartridge, not shown, the ink is distributed to the respective pressure generating chambers 11 via the ink supply channel 23. Actually, the piezoelectric elements 17 are contracted by applying a voltage to the piezoelectric elements 17. Accordingly, the diaphragm 15 is deformed together with the piezoelectric elements 17 and hence the capacities of the pressure generating chambers 11 are increased, whereby ink is drawn into the pressure generating chambers 11. After having filled ink in the interior thereof up to the nozzle openings 13, the voltage applied to the electrode forming materials 32 and 33 of the piezoelectric elements 17 is released according to print signals supplied via the wiring board 41. Accordingly, the piezoelectric elements 17 are expanded and hence are restored to the original state, and the diaphragm 15 is displaced to the original state. As a result, the capacities of the pressure generating chambers 11 are reduced and hence the pressures in the pressure generating chambers 11 are increased, so that ink drops are discharged from the nozzle openings 13.

Figure 3A:
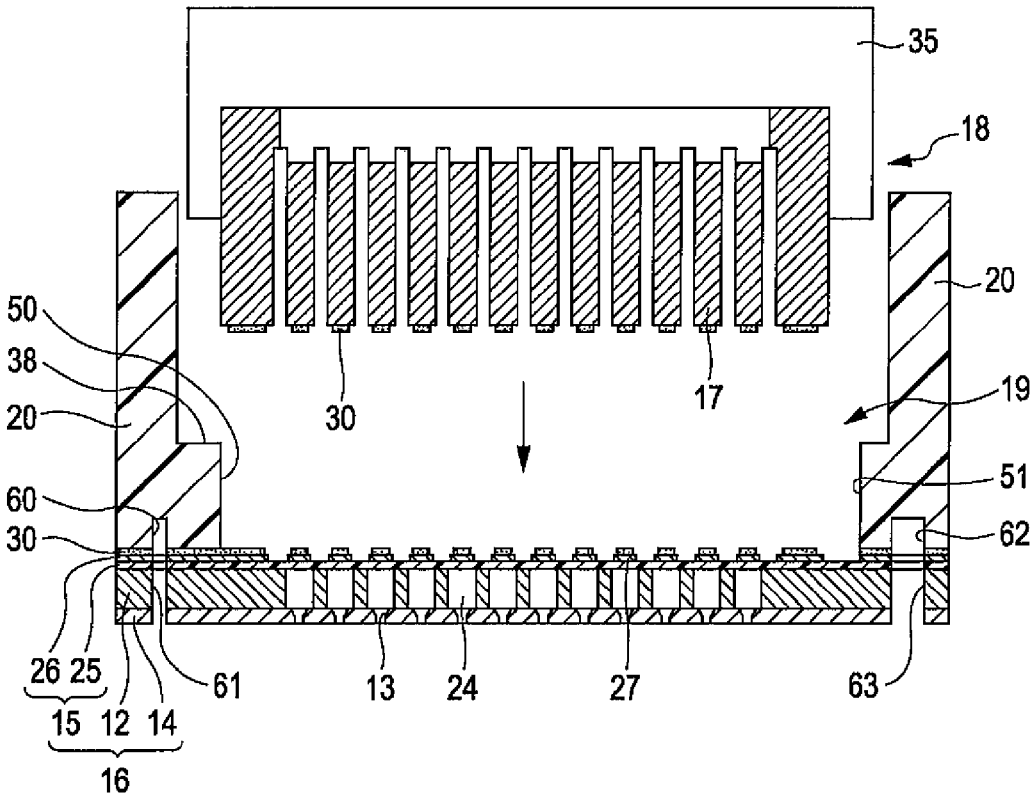
FIGS. 3A and 3B are cross-sectional views showing a method of manufacturing the printhead according to the first embodiment of the invention.
Figure 3B:
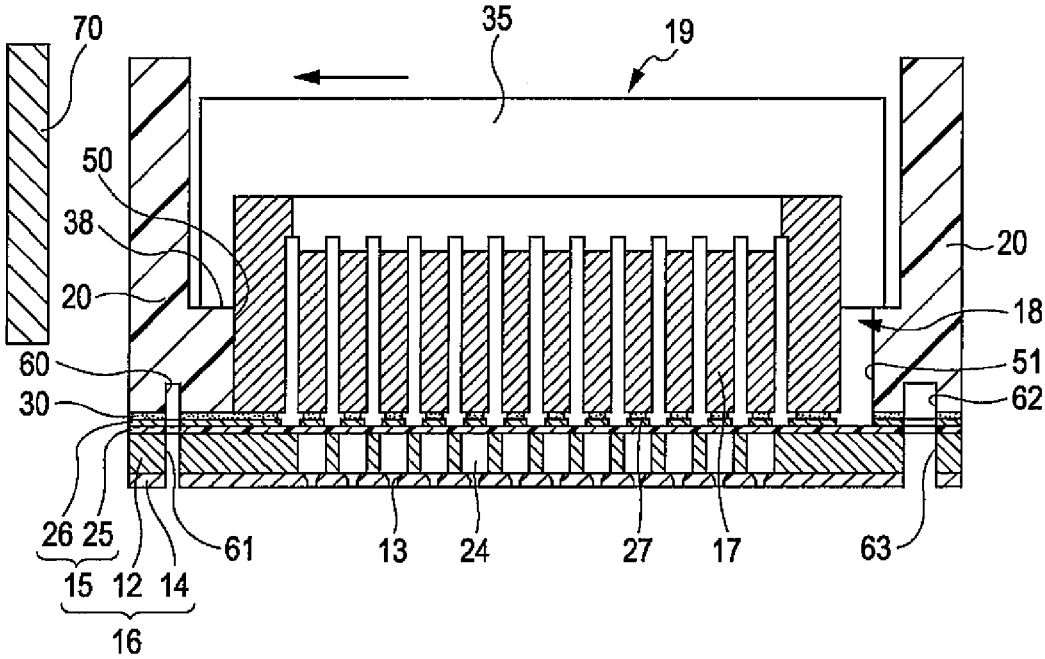

A method of manufacturing the ink jet printhead as described above will be descried. FIGS. 3A and 3B are cross-sectional views showing a method of manufacturing the ink jet printhead according to the first embodiment of the invention in the short side direction of the pressure generating chambers.

First of all, as shown in FIG. 3A, the piezoelectric element unit 18 is inserted into the storage portion 19 of the case head 20 which is fixed to the flow channel unit 16. The flow channel unit 16 and the case head 20 are positioned by inserting the positioning pins in the positioning holes 60 to 63 provided thereon as descried above, whereby the alignment surface 50 of the case head 20 and the island portions 27 of the flow channel unit 16 are positioned with a high degree of accuracy.

As shown in FIG. 3B, a magnet 70 (which corresponds to an alignment magnet in claims) is arranged outside the case head 20 at a position corresponding to the alignment surface 50 to cause the fixed substrate 35 is attracted toward the alignment surface 50 of the case head 20, whereby part of the piezoelectric element unit 18, in the first embodiment, the side surface of the piezoelectric element 17 on the one side in the direction of parallel arrangement of the piezoelectric elements 17 is in abutment with the alignment surface 50. Accordingly, the positioning between the case head 20 and the piezoelectric element unit 18 is achieved, so that the positioning between the piezoelectric elements 17 and the island portions 27 is achieved with a high degree of accuracy. Subsequently, as shown in FIGS. 2A and 2B, by filing the adhesive agent 39 between the fixed substrate 35 and the case head 20, the case head 20 and the piezoelectric element unit 18 are fixed. By applying the adhesive agent 30 on the distal end surfaces of the piezoelectric elements 17 before inserting the piezoelectric element unit 18 into the storage portion 19, the distal end surfaces of the piezoelectric elements 17 and the island portions 27 are bonded to each other. At this time, even when the piezoelectric elements 17 and the island portions 27 are in abutment with each other via the adhesive agent 30, the piezoelectric element unit 18 can be moved in the direction of parallel arrangement of the piezoelectric elements 17 (the short side direction of the piezoelectric elements 17) with respect to the case head 20 as long as it is before the adhesive agent 30 is cured.

When curing the adhesive agent 39 for bonding the case head 20 and the fixed substrate 35, by not releasing the attraction by the magnet 70, the case head 20 and the piezoelectric element unit 18 are joined in a state of being positioned with a high degree of accuracy without causing the positional displacement between the piezoelectric elements 17 and the island portions 27. The magnet 70 for positioning between the case head 20 and the piezoelectric element unit 18 as such may be a permanent magnet or an electromagnet.

Although the fixed substrate 35 is moved with respect to the case head 20 by the magnet 70 after having inserted the piezoelectric element unit 18 into the case head 20 in the first embodiment, the invention is not limited thereto. For example, when inserting the piezoelectric element unit 18 into the case head 20, it may be inserted by moving the fixed substrate 35 with respect to the case head 20 by the magnet 70 while bringing the side surface of the piezoelectric element 17 on the one side in the direction of parallel arrangement of the piezoelectric elements 17 into abutment with and sliding on the alignment surface 50. Accordingly, the amount of movement of the piezoelectric elements 17 when being moved in the short side direction in a state in which the piezoelectric elements 17 and the island portions 27 are in abutment with each other via the adhesive agent 30 may be reduced, and hence the deterioration of displacement characteristics of the diaphragm 15 due to the adhesive agent 30 attached to areas other than the island portions 27 is avoided.

Incidentally, although it is contemplated to bring the side surface of the piezoelectric element 17 into abutment with the alignment surface 50 of the case head 20 by a gravitational force by inclining the ink jet printhead 10 so that the alignment surface 50 comes to the lower side in the vertical direction without providing the magnet 70, since the distal end surfaces of the piezoelectric elements 17 and the island portions 27 are in abutment with each other via the adhesive agent 30 as described above, it is difficult to move the piezoelectric element unit 18 with respect to the case head 20 by the viscosity of the adhesive agent 30 even before being cured and the reliability is lowered. In the first embodiment, the piezoelectric element unit 18 can be moved easily against the viscosity of the adhesive agent 30 by the magnet 70, so that improvement of the reliability of the positioning is achieved.

In the first embodiment, since the piezoelectric element 17 of the piezoelectric element unit 18 is brought into abutment with the alignment surface 50 of the case head 20, the positioning between the piezoelectric elements 17 and the island portions 27 is achieved with a higher degree of accuracy in comparison with the case of bringing other members which constitute the piezoelectric element unit 18 into contact with the alignment surface.

Second Embodiment

Figure 4:
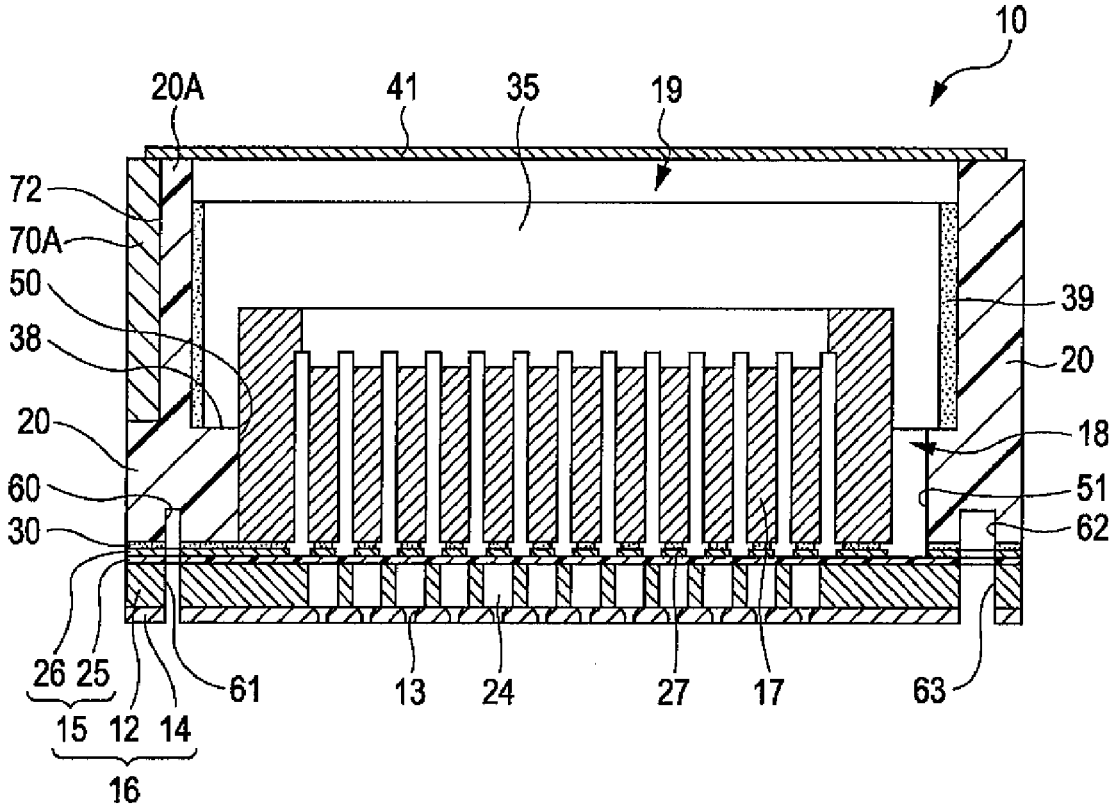
FIG. 4 is a cross-sectional view of a printhead according to a second embodiment of the invention.

FIG. 4 is a cross-sectional view of an ink jet printhead as an example of the liquid ejecting head according to a second embodiment of the invention. The like elements are designated by the same numbers as in the first embodiment described above and overlapped description will be omitted.

As shown in FIG. 4, the ink jet printhead 10 in the second embodiment is provided with a magnet 70A (which corresponds to an alignment magnet in claims) on the side of the alignment surface 50 of a case head 20A. The position to provide the magnet 70A may be any of the outer peripheral surface side, the inner peripheral surface side, or the midpoint in the direction of thickness of the case head 20A. In the second embodiment, a depressed portion 72 is provided on the outer peripheral surface side of the case head 20A, and the magnet 70A is fixed in the depressed portion 72. Incidentally, when fixing the magnet 70A on the inner peripheral surface side of the case head 20A, a predetermined clearance is preferably provided between the surface of the magnet 70A and the fixed substrate 35.

It is also applicable to form the case head 20A integrally with the magnet 70A. In other words, when forming the case head 20A formed of the resin material by molding, the case head 20A may be molded integrally so that the magnet 70A is provided in the interior thereof. In this manner, by integrally forming the case head 20A together with the magnet 70A, the process to bond the case head 20A to the magnet 70A is not necessary, so that reduction of the manufacturing cost of the case head 20A is achieved.

With the ink jet printhead 10 configured in this manner, since the piezoelectric element unit 18 and the case head 20A are positioned and fixed with respect to each other with a high degree of accuracy, improvement of the ink discharging characteristics is achieved.

Here, a method of manufacturing the ink jet printhead in the second embodiment will be described. FIG. 5 is a cross-sectional view showing a method of manufacturing the ink jet printhead according to the second embodiment.

Figure 5A:
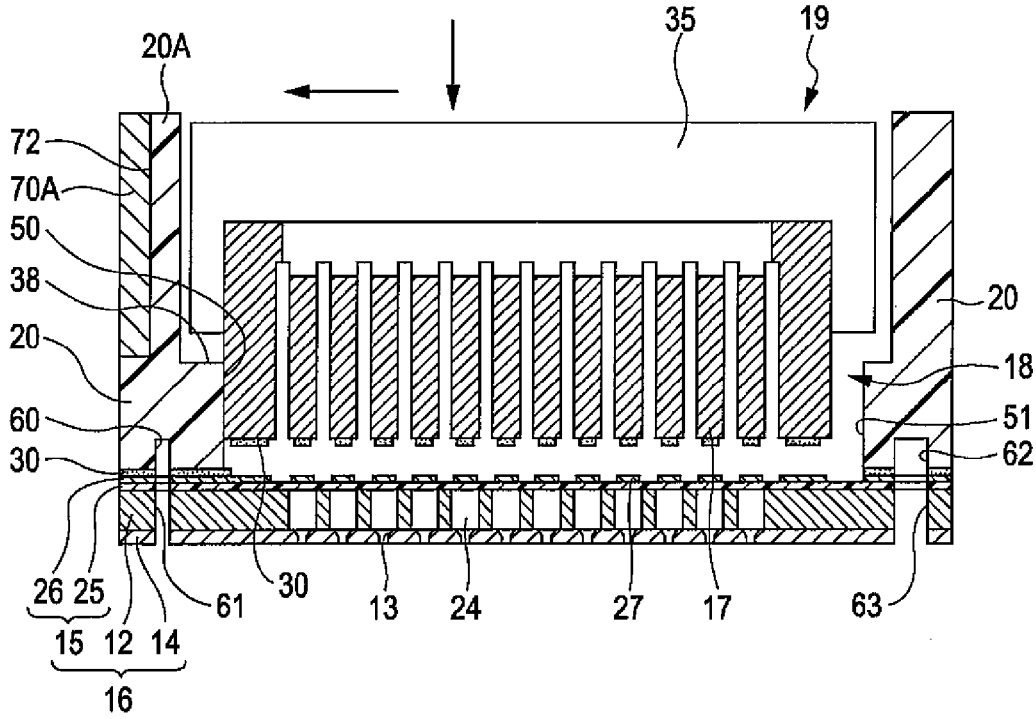
FIGS. 5A and 5B are cross-sectional views showing a method of manufacturing the printhead according to the second embodiment of the invention.

First of all, as shown in FIG. 5A, the piezoelectric element unit 18 is inserted into the storage portion 19 of the case head 20A which is fixed to the flow channel unit 16. At this time, since the case head 20A is provided with the magnet 70A in advance, the fixed substrate 35 is attracted toward the alignment surface 50 of the case head 20A by a magnetic force, and is moved, that is, slid in a state in which the side surface of the piezoelectric element 17 on the one side in the direction of parallel arrangement of the piezoelectric elements 17 is in abutment with the alignment surface 50.

Figure 5B:
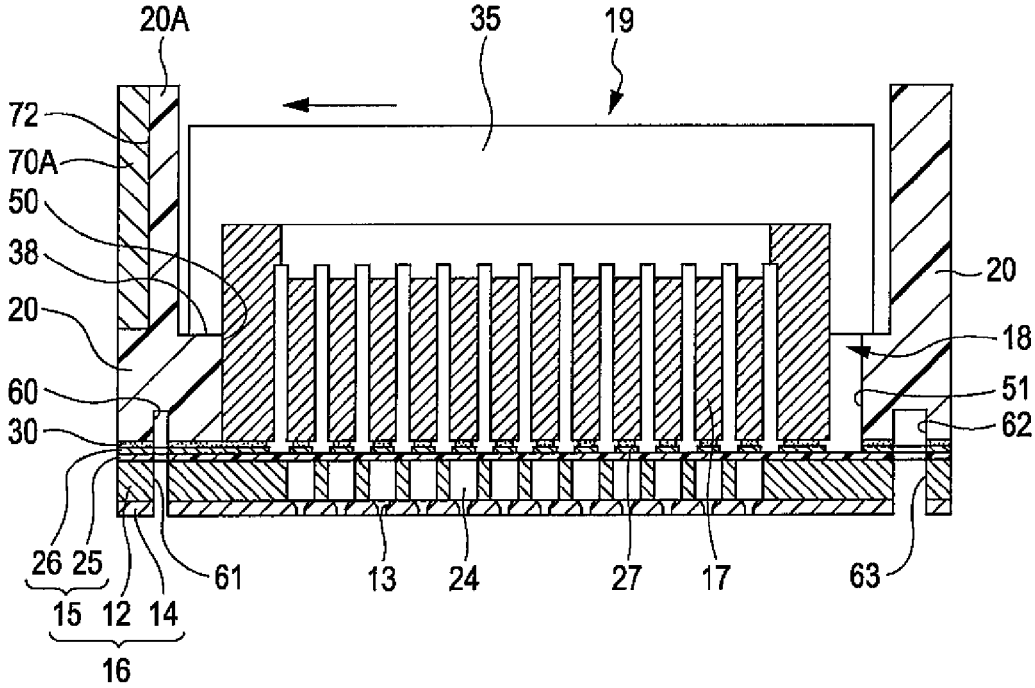

Then, as shown in FIG. 5B, the piezoelectric element unit 18 is inserted until the distal end surfaces of the piezoelectric elements 17 come into abutment with the island portions 27 via the adhesive agent 30. At this time, since the case head 20A is provided with the magnet 70A in advance, the fixed substrate 35 is attracted toward the alignment surface 50 of the case head 20A by the magnetic force and the side surface of the piezoelectric element 17 on the one side in the direction of parallel arrangement of the piezoelectric elements 17 comes into abutment with the alignment surface 50. Accordingly, the positioning between the case head 20 and the piezoelectric element unit 18 is achieved, so that the positioning between the piezoelectric elements 17 and the island portions 27 is achieved with a high degree of accuracy. Thereafter, the fixed substrate 35 and the case head 20A are joined using the adhesive agent 39.

In this manner, in the second embodiment, since the magnet 70A is provided in the case head 20A, the fixed substrate 35 is attracted toward the alignment surface 50 of the case head 20A by the magnetic force while the piezoelectric element unit 18 is inserted into the storage portion 19 of the case head 20A. Therefore, the piezoelectric element unit 18 is inserted in a state in which the side surface of the piezoelectric element 17 on the one side in the direction of arrangement of the piezoelectric elements 17 is in sliding contact with the alignment surface 50. Accordingly, it is not necessary to move the piezoelectric element unit 18 in the state in which the piezoelectric elements 17 and the island portions 27 are in abutment with each other via the adhesive agent 30, and hence the deterioration of displacement characteristics of the diaphragm 15 due to the adhesive agent 30 attached to areas other than the island portions 27 is reliably avoided.

Since the attraction of the fixed substrate 35 toward the alignment surface 50 of the case head 20A by the magnet 70A is not released even when causing the adhesive agent 30 for bonding the distal end surfaces of the piezoelectric elements 17 to the island portions 27 to be cured, the positional displacement between the distal end surfaces of the piezoelectric elements 17 and the island portions 27 is prevented reliably from occurring when causing the adhesive agent 30 to be cured.

Third Embodiment

Figure 6A:
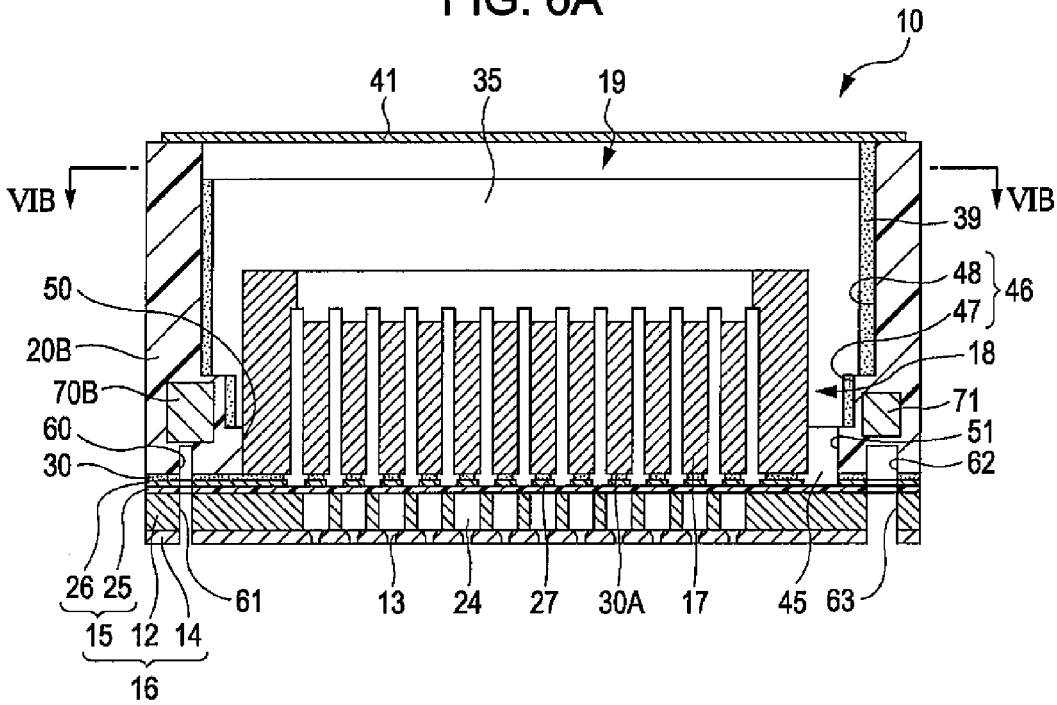
FIGS. 6A and 6B are cross-sectional views of a printhead according to a third embodiment of the invention.
Figure 6B:
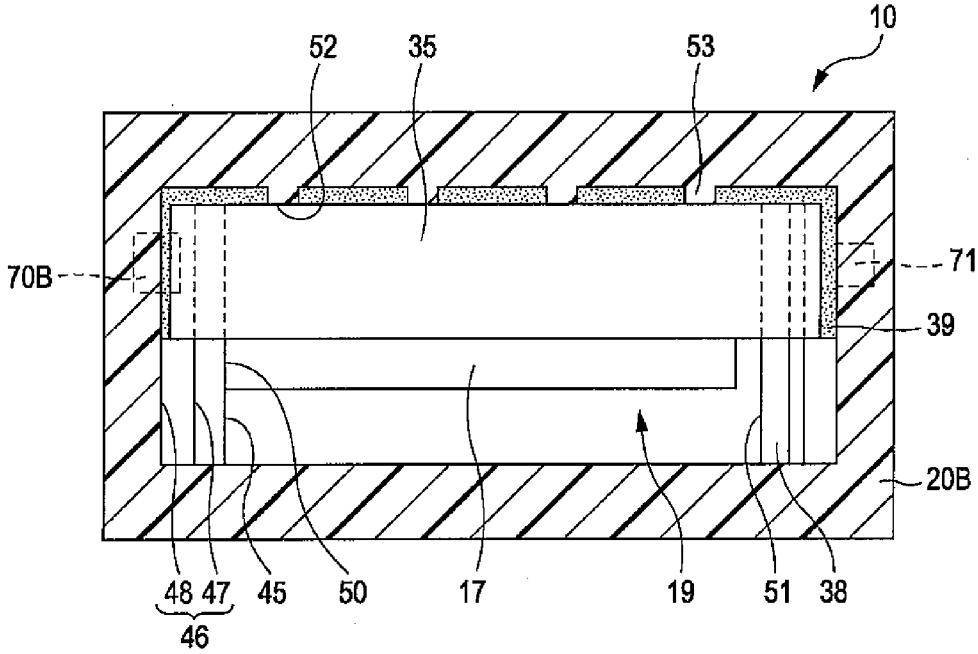

FIGS. 6A and 6B are a cross-sectional view of an ink jet printhead taken in the longitudinal direction of the pressure generating chamber and a cross-sectional view taken along the line VIB-VIB thereof as an example of the liquid ejecting head according to a third embodiment of the invention. The like elements are designated by the same numbers as in the first embodiment described above and overlapped description will be omitted.

As shown in FIGS. 6A and 6B, an alignment magnet 70B is provided on the side of the alignment surface 50 on one side of a case head 20B in the direction of parallel arrangement of the piezoelectric elements 17, and a fixing magnet 71 is provided on the opposite side from the alignment surface 50. In other words, the alignment magnet 70B and the fixing magnet 71 are provided on the both sides of the case head 20B in the direction of parallel arrangement of the piezoelectric elements 17.

The alignment magnet 70B and the fixing magnet 71 as described above adhere the piezoelectric element unit 18 to the case head 20B and, when bonding the distal ends of the piezoelectric elements 17 to the island portions 27, press the piezoelectric element unit 18 toward the flow channel unit 16. Therefore, the alignment magnet 70B and the fixing magnet 71 are preferably arranged at positions which allow the magnetic forces to press the fixed substrate 35 formed of the magnetic material toward the flow channel unit 16 and, in the third embodiment, the alignment magnet 70B and the fixing magnet 71 are arranged between the fixed substrate 35 and the flow channel unit 16 by providing the alignment magnet 70B and the fixing magnet 71 on both sides of a narrowed portion 47 of a fixed substrate holding hole 46 respectively.

The alignment magnet 70B serves to attract the fixed substrate 35 toward the alignment surface 50, and bring the alignment surface 50 and the piezoelectric elements 17 into abutment with each other for positioning. Therefore, the alignment magnet 70B is provided so as to provide a stronger magnetic field with respect to the fixed substrate 35 than that of the fixing magnet 71 with respect to the fixed substrate 35. In the third embodiment, the alignment magnet 70B employed here has larger outer dimensions than the fixing magnet 71, and a stronger magnetic field. The alignment magnet 70B and the fixing magnet 71 are not limited thereto, and it is also applicable, for example, to employ the alignment magnet 70B and the fixing magnet 71 having the same size and arrange the same so that the distance between the alignment magnet 70B and the storage portion 19 (fixed substrate 35) is smaller than the distance between the fixing magnet 71 and the storage portion 19 (fixed substrate 35). In this manner, by changing the distance from the fixed substrate 35 to the magnet, the strength of the magnetic field with respect to the fixed substrate 35 can be changed. It is also possible to attract the fixed substrate 35 toward the alignment magnet 70B by a magnetic force by inverting the polarities of the alignment magnet 70B and the fixing magnet 71 with respect to the fixed substrate 35.

In the third embodiment, part of the flow channel unit 16, for example, the supporting panel 26 fixed to the case head 203 is formed of the magnetic material. Accordingly, the alignment magnet 70B and the fixing magnet 71 have a function to urge the case head 20B and the flow channel unit 16 by causing the same to be attracted to each other by the magnetic forces when bonding the case head 20B and the flow channel unit 16. Therefore, the alignment magnet 70B and the fixing magnet 71 are preferably provided on the side of the flow channel unit 16 of the case head 20B. In this manner, pressing jig or the like is not necessary for bonding by causing the case head 20B and the flow channel unit 16 to urge each other by the magnetic forces of the alignment magnet 70B and the fixing magnet 71.

The alignment magnet 70B and the fixing magnet 71 as described above may be, for example, a permanent magnet or an electromagnet.

Figure 7A:
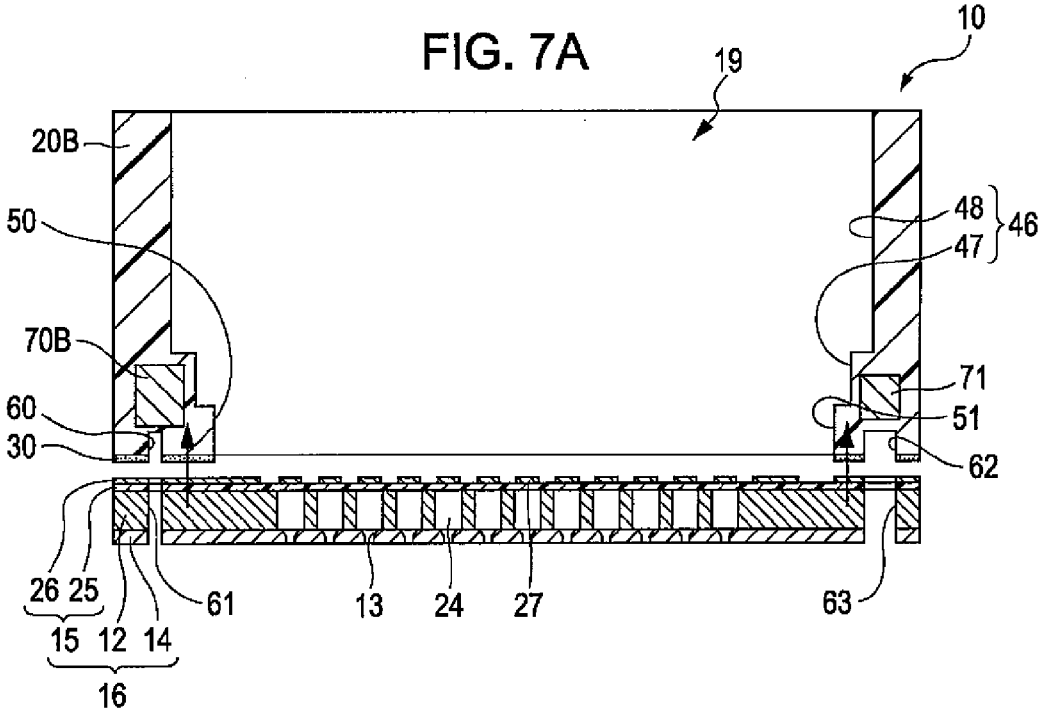
FIGS. 7A and 7B are cross-sectional views showing a method of manufacturing the printhead according to the third embodiment of the invention.
Figure 7B:
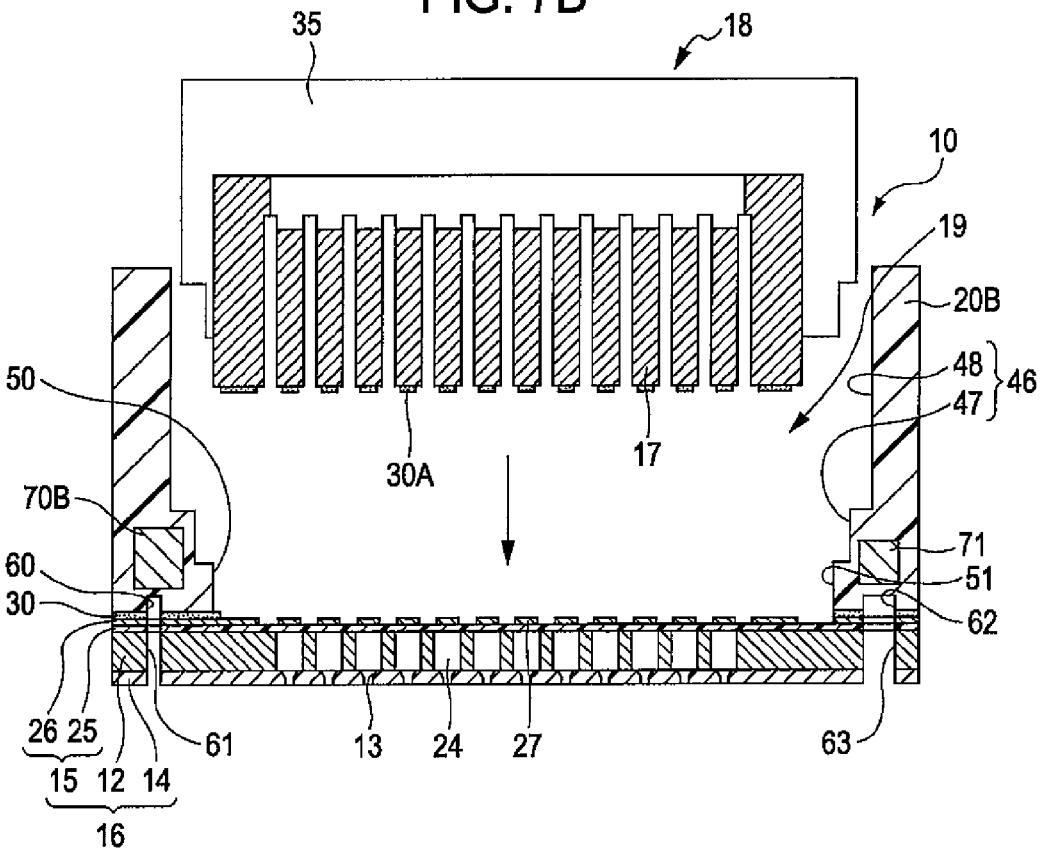
Figure 8:
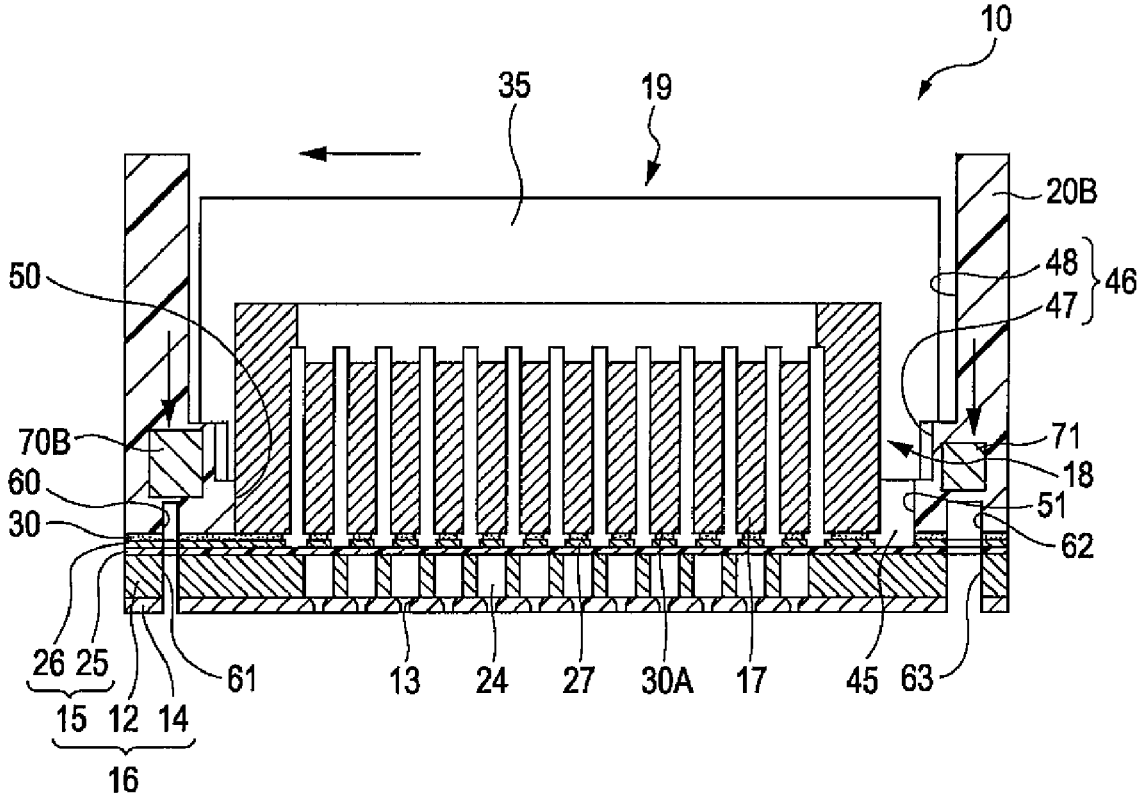
FIG. 8 is a cross-sectional view showing a method of manufacturing the printhead according to the third embodiment of the invention.

A method of manufacturing the ink jet printhead as described above will be descried. FIGS. 7A and 7B and FIG. 8 are cross-sectional views showing a method of manufacturing the ink jet printhead according to the third embodiment of the invention in the short side direction of the pressure generating chambers.

First of all, as shown in FIG. 7A, the flow channel unit 16 and the case head 20B are bonded to each other via the adhesive agent 30. At this time, the flow channel unit 16 and the case head 20B are positioned by inserting the positioning pins (not shown) in the positioning holes 60 to 63 provided thereon as descried above, whereby the alignment surface 50 of the case head 20 and the island portions 27 of the flow channel unit 16 are positioned with a high degree of accuracy.

In the third embodiment, since the supporting panel 26 which constitutes the diaphragm 15 of the flow channel unit 16 is formed of the magnetic material, the flow channel unit 16 and the case head 20B are brought into a state of being pressed each other by the magnetic fields of the alignment magnet 70B and the fixing magnet 71. Therefore, it is not necessary to press the flow channel unit 16 and the case head 20B each other with the jig or the like while causing the adhesive agent 30 to be cured, so that simplification of the manufacturing process and cost reduction are achieved.

Subsequently, as shown in FIG. 7B, the piezoelectric element unit 18 is inserted into the storage portion 19 of the case head 20B. At this time, since the case head 20B is provided with the alignment magnet 70B in advance, the fixed substrate 35 is attracted toward the alignment surface 50 of the case head 20B by the magnetic force, and is moved, that is, slid in a state in which the side surface of the piezoelectric element 17 on the one side in the direction of parallel arrangement of the piezoelectric elements 17 is in abutment with the alignment surface 50. The piezoelectric element unit 18 is attracted toward the flow channel unit 16 by the magnetic fields of the alignment magnet 70B and the fixing magnet 71.

Then, as shown in FIG. 8, the piezoelectric element unit 18 is inserted until the distal end surfaces of the piezoelectric elements 17 come into abutment with the island portions 27 via an adhesive agent 30A. At this time, since the case head 20B is provided with the alignment magnet 70B so that the magnetic field with respect to the fixed substrate 35 is stronger than that with respect to the fixing magnet 71, the fixed substrate 35 is attracted toward the alignment surface 50 of the case head 20B by the magnetic force, and the side surface of the piezoelectric element 17 on the one side in the direction of parallel arrangement of the piezoelectric elements 17 comes into abutment with the alignment surface 50. Accordingly, the positioning between the case head 20B and the piezoelectric element unit 18 is achieved, so that the positioning between the piezoelectric elements 17 and the island portions 27 is achieved with a high degree of accuracy.

By applying the adhesive agent 30A on the distal end surfaces of the piezoelectric elements 17 before inserting the piezoelectric element unit 18 into the storage portion 19, the distal end surfaces of the piezoelectric elements 17 and the island portions 27 are bonded to each other. At this time, even when the piezoelectric elements 17 and the island portions 27 are in abutment with each other via the adhesive agent 30A, the piezoelectric element unit 18 can be moved in the direction of parallel arrangement of the piezoelectric elements 17 (the short side direction of the piezoelectric elements 17) with respect to the case head 20B by the magnetic field of the alignment magnet 70B as long as it is before the adhesive agent 30A is cured.

The piezoelectric element unit 18 inserted into the case head 20B in this manner is pressed toward the flow channel unit 16 by the magnetic fields of the alignment magnet 70B and the fixing magnet 71. By causing the adhesive agent 30A for bonding the distal ends of the piezoelectric elements 17 and the island portions 27 to be cured in a state in which the piezoelectric element unit 18 is pressed toward the flow channel unit 16 by the magnetic field as described above, the piezoelectric element unit 18 and the flow channel unit 16 are bonded to each other.

Subsequently, as shown in FIG. 6, the fixed substrate 35 and the case head 20B are joined using the adhesive agent 39.

In this manner, in the third embodiment, since the alignment magnet 70B is provided in the case head 20B, and the fixed substrate 35 is attracted toward the alignment surface 50 of the case head 20B by the magnetic force while the piezoelectric element unit 18 is inserted into the storage portion 19 of the case head 20B by the magnetic field of the alignment magnet 70B. Therefore, the piezoelectric element unit 18 is inserted into the storage portion 19 of the case head 20B in a state in which the side surface of the piezoelectric element 17 on the one side in the direction of parallel arrangement of the piezoelectric elements 17 is in sliding contact with the alignment surface 50. Accordingly, the amount of movement of the piezoelectric elements 17 when being moved in the short side direction in a state in which the piezoelectric elements 17 and the island portions 27 are in abutment with each other via the adhesive agent 30A may be reduced, and hence the deterioration of displacement characteristics of the diaphragm 15 due to the adhesive agent 30A attached to areas other than the island portions 27 is reliably prevented.

Since the attraction of the fixed substrate 35 toward the alignment surface 50 of the case head 20B by the alignment magnet 70B is not released even when causing the adhesive agent 30A for bonding the distal end surfaces of the piezoelectric elements 17 to the island portions 27 to be cured, the positional displacement between the distal end surfaces of the piezoelectric elements 17 and the island portions 27 are prevented reliably from occurring when causing the adhesive agent 30A to be cured.

Incidentally, although it is contemplated to bring the side surface of the piezoelectric element 17 into abutment with the alignment surface 50 of the case head 20B by the gravitational force by inclining the ink jet printhead 10 so that the alignment surface 50 comes to the lower side in the vertical direction without providing the alignment magnet 70B, since the distal end surfaces of the piezoelectric elements 17 and the island portions 27 are in abutment with each other via the adhesive agent 30A as described above, it is difficult to move the piezoelectric element unit 18 with respect to the case head 20B by the viscosity of the adhesive agent 30A even before being cured and the reliability is lowered. Also, the adhesion failure between the piezoelectric element unit 18 and the flow channel unit 16 may occur only by pressing the piezoelectric element unit 18 toward the flow channel unit 16 by the gravitational force. In the invention, the piezoelectric element unit 18 can be moved easily against the viscosity of the adhesive agent 30A by the alignment magnet 70B, and the attraction of the piezoelectric elements 17 toward the alignment surface 50 is not released when causing the adhesive agent 30A to be cured, so that improvement of the reliability of the positioning is achieved. Also, since the pressure which presses the piezoelectric element unit 18 toward the flow channel unit 16 can be adjusted by the magnetic forces of the alignment magnet 70B and the fixing magnet 71 and the both members are reliably bonded to each other by pressing with a desired pressure.

In the third embodiment, since the piezoelectric element 17 of the piezoelectric element unit 18 is brought into abutment with the alignment surface 50 of the case head 20B, the positioning between the piezoelectric elements 17 and the island portions 27 is achieved with a higher degree of accuracy in comparison with the case of bringing other members which constitute the piezoelectric element unit 18 into contact with the alignment surface.

Also, by providing the alignment magnet 70B and the fixing magnet 71 on the case head 20B, adhesion in a state in which the piezoelectric element unit 18 is pressed toward the flow channel unit 16 by the magnetic fields is achieved. Therefore, the jig or the like for pressing the piezoelectric element unit 18 is not necessary, so that reduction of the manufacturing cost is achieved.

Fourth Embodiment

Figure 9:
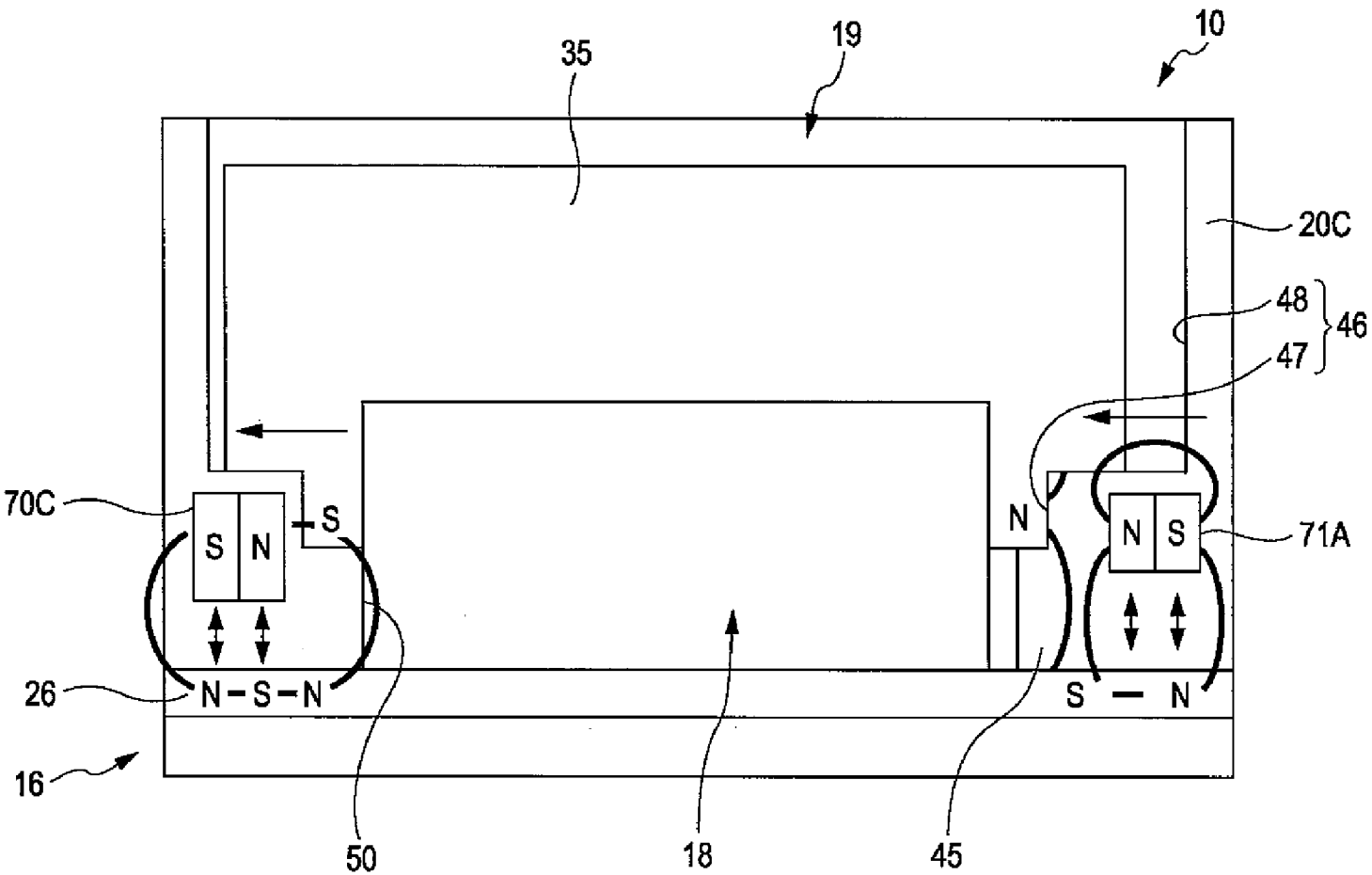
FIG. 9 is a drawing schematically showing a printhead according to a fourth embodiment of the invention.

FIG. 9 is a drawing schematically showing the rough configuration of an ink jet printhead as an example of the liquid ejecting head according to a fourth embodiment of the invention. The like elements are designated by the same numbers as in the embodiments described above and overlapped description will be omitted.

As shown in FIG. 9, an alignment magnet 70C is provided on a case head 20C on the side of the alignment surface 50 in the fourth embodiment so as to have a magnetic pole different from the side of the alignment surface 50 in the direction of alignment opposite from the alignment surface 50. In other words, the direction of alignment means the direction of parallel arrangement of the piezoelectric elements 17 in the fourth embodiment, and the alignment magnet 70C is arranged so that the both ends in the direction of parallel arrangement of the piezoelectric elements 17 correspond respectively to N-pole and S-pole. In the fourth embodiment, the alignment magnet 70C is provided so as to have N-pole on the side of the fixed substrate 35 (alignment surface side) and S-pole on the opposite side from the fixed substrate 35 in the direction of parallel arrangement of the piezoelectric elements 17.

In contrast, a fixing magnet 71A is provided on the case head 20C on the opposite side from the alignment surface 50. The fixing magnet 71A is provided so as to invert the magnetic pole from the alignment magnet 70C in the direction of alignment. In other words, in the fourth embodiment, since the alignment magnet 70C is arranged so as to have N-pole on the side of the fixed substrate 35, and the fixing magnet 71A is provided so as to have N-pole on the side of the fixed substrate 35 and S-pole on the opposite side from the fixed substrate 35.

The alignment magnet 70C and the fixing magnet 71A are provided so that the magnetic field of the alignment magnet 70C with respect to the fixed substrate 35 is larger than the magnetic field of the fixing magnet 71A with respect to the fixed substrate 35. Specifically, it is realized by increasing the outer dimensions of the alignment magnet 70C to a size larger than the fixing magnet 71A, or by shortening the distance between the alignment magnet 70C and the fixed substrate 35 than the distance between the fixing magnet 71A and the fixed substrate 35. In the fourth embodiment, a magnet having larger outer dimensions than the fixing magnet 71A is employed as the alignment magnet 70C. It is also possible to provide the alignment magnet 70C and the fixing magnet 71A having the same size or having the same distance to the fixed substrate 35 as a matter of course. The alignment magnet 70C and the fixing magnet 71A as described above are rod magnet types having N-pole and S-pole at both ends thereof.

Then, the fixed substrate 35 assumes a magnetic property of S-pole on the side of the alignment surface 50 by the magnetic field of N-pole of the alignment magnet 70C. Accordingly, the fixed substrate 35 is attracted toward the alignment magnet 70, that is, toward the alignment surface 50. The fixed substrate 35 assumes magnetic properties of S-pole on the side of the alignment surface 50 and N-pole on the opposite side from the alignment surface 50. Then the fixing magnet 71A has N-pole on the side of the fixed substrate 35, the fixed substrate 35 is pressed toward the alignment surface 50 by repulsion between N-pole of the fixed substrate 35 and N-pole of the fixing magnet 71A each other. In this manner, the fixed substrate 35 is attracted toward the alignment surface 50 of the case head 20C by the attraction by the alignment magnet 70C and the repulsion by the fixing magnet 71A.

In contrast, the supporting panel 26 of the flow channel unit 16 assumes magnetic properties of N-pole and S-pole on the side of the alignment surface 50 corresponding to the magnetic poles of the alignment magnet 70C as shown in FIG. 9. The supporting panel 26 assumes the magnetic properties of N-pole and S-pole also on the side of the fixing magnet 71A. In this manner, by the supporting panel 26 assuming the magnetic properties of N-pole and S-pole by the alignment magnet 70C and the fixing magnet 71A, the flow channel unit 16 is attracted toward the case head 20C.

Figure 10:
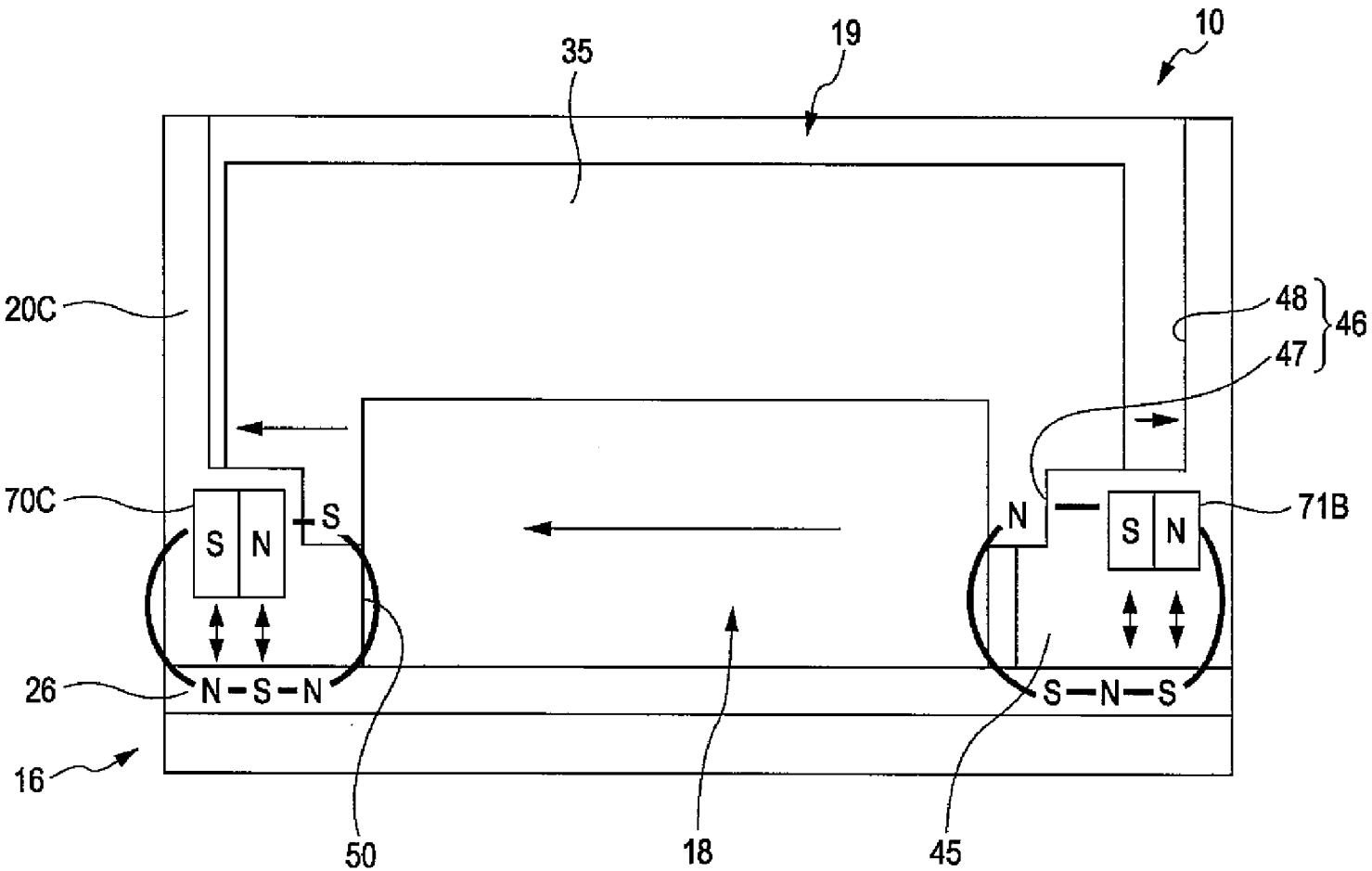
FIG. 10 is a drawing schematically showing another example of the printhead according to the fourth embodiment of the invention.

The direction of magnetic poles of the alignment magnet 70C and the fixing magnet 71A is not limited to those described above and, for example, the direction of the magnetic pole of the alignment magnet 70C and the direction of the magnetic pole of the fixing magnet 71A may be set to the same direction. In other words, as shown in FIG. 10, when the alignment magnet 70C is provided on the case head 20C so as to have N-pole on the side of the fixed substrate 35 in the same manner as shown in FIG. 9, a fixing magnet 71B may be provided so as to have S-pole on the side of the fixed substrate 35. However, when the alignment magnet 70C and the fixing magnet 71B are arranged to have the magnetic pole of the same direction, the fixed substrate 35 is attracted toward the alignment magnet 70C and also attracted toward the fixing magnet 71B on the opposite side from the alignment magnet 70C. Therefore, it is necessary to set the magnitude of the magnetic field of the alignment magnet 70C with respect to the fixed substrate 35 to a level larger than the magnitude of the fixing magnet 71B with respect to the fixed substrate 35 to make an attracting force of the alignment magnet 70C with respect to the fixed substrate 35 larger. Accordingly, the fixed substrate 35 can be struck to the alignment surface 50 of the case head 20C by the alignment magnet 70C.

Fifth Embodiment

Figure 11:
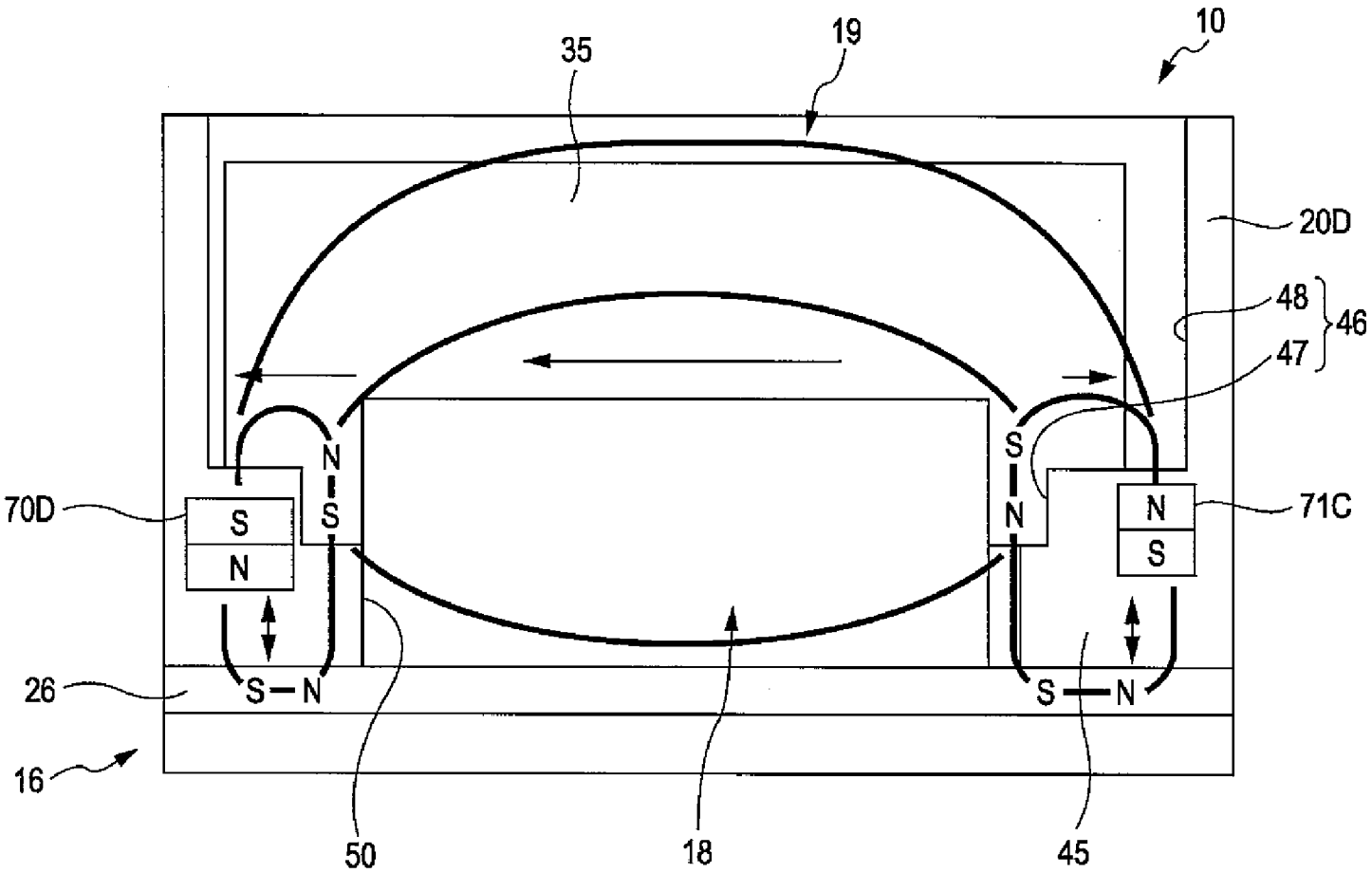
FIG. 11 is a drawing schematically showing a printhead according to a fifth embodiment of the invention.

FIG. 11 is a drawing schematically showing the rough configuration of an ink jet printhead as an example of the liquid ejecting head according to a fifth embodiment of the invention. The like elements are designated by the same numbers as in the embodiments described above and overlapped description will be omitted.

As shown in FIG. 11, an alignment magnet 70D is provided on a case head 20D in the fifth embodiment on the side of the alignment surface 50 so as to have a magnetic pole different from the side of the flow channel unit 16 in the direction opposite from the flow channel unit 16. In other words, the alignment magnet 70D is provided in the direction in which the both ends in the direction of arrangement of the case head 20D and the flow channel unit 16 have N-pole and S-pole respectively. In the fifth embodiment, the alignment magnet 70D is provided so as to have N-pole on the side of the flow channel unit 16 and S-pole on the side of the wiring board 41, which is opposite from the flow channel unit 16 (see FIG. 2).

In contrast, a fixing magnet 71C is provided on the case head 20D on the opposite side from the alignment surface 50. The fixing magnet 71C is provided so as to invert the magnetic pole from the alignment magnet 70D. In other words, in the fifth embodiment, since the alignment magnet 70D is arranged so as to have N-pole on the side of the flow channel unit 16, and the fixing magnet 71C is provided so as to have S-pole on the side of the flow channel unit 16 and N-pole on the side of the wiring board 41 (see FIG. 2).

In this configuration, the fixed substrate 35 assumes the magnetic properties of S-pole and N-pole on the side of the alignment surface 50 according to the magnetic fields of N-pole and S-pole of the alignment magnet 70D. At this time, the fixed substrate 35 assumes the magnetic property of S-pole on the side of the flow channel unit 16.

Also, the fixed substrate 35 assumes the magnetic properties of N-pole and S-pole by the magnetic fields of S-pole and N-pole of the fixing magnet 71C. At this time, the fixed substrate 35 assumes the magnetic property of N-pole on the side of the flow channel unit 16.

The alignment magnet 70D and the fixing magnet 71C are provided so that the magnetic field of the alignment magnet 70D with respect to the fixed substrate 35 is larger than the magnetic field of the fixing magnet 71C with respect to the fixed substrate 35. Specifically, it is realized by increasing the outer dimensions of the alignment magnet 70D to a size larger than the fixing magnet 70C, or by shortening the distance between the alignment magnet 70D and the fixed substrate 35 than the distance between the fixing magnet 71C and the fixed substrate 35. In the fifth embodiment, a magnet having larger outer dimensions than the fixing magnet 71C is employed as the alignment magnet 70D. The alignment magnet 70D and the fixing magnet 71C as described above are rod magnet types having N-pole and S-pole at both ends thereof.

In this manner, the case head 20D can be struck to the alignment surface 50 by attracting the fixed substrate 35 toward one of the magnets (toward the side of the alignment magnet 70D in the fifth embodiment) by changing the magnitude of the magnetic fields of the alignment magnet 70D and the fixing magnet 71C with respect to the fixed substrate 35. In other words, in the fifth embodiment, the fixed substrate 35 is attracted toward the alignment magnet 70D and also attracted toward the fixing magnet 71C on the opposite side from the alignment magnet 70D. Therefore, it is necessary to set the magnitude of the magnetic field of the alignment magnet 70D with respect to the fixed substrate 35 to a level larger than the magnitude of the fixing magnet 71C with respect to the fixed substrate 35 to make an attracting force of the alignment magnet 70D with respect to the fixed substrate 35 larger.

The supporting panel 26 of the flow channel unit 16 assumes the magnetic properties of S-pole in an area opposing the alignment magnet 70D, and N-pole in the area opposing the fixed substrate 35 on the side of the alignment magnet 70D. Also, the supporting panel 26 of the flow channel unit 16 assumes the magnetic properties of N-pole in an area opposing the fixing magnet 71C, and S-pole on the side of the fixing magnet 71C. In other words, the supporting panel 26 of the flow channel unit 16 assumes magnetic properties as S-pole, N-pole, S-pole, and N-pole alternately arranged from the alignment magnet 70D toward the fixing magnet 71C.

In this manner, by the supporting panel 26 assuming the magnetic properties by the alignment magnet 70D and the fixing magnet 71C, the flow channel unit 16 is attracted toward the case head 20D. By the arrangement of the magnetic properties as described above, the force of attraction between the flow channel unit 16 and the case head 20D is increased, and the both members are firmly attracted.

It is also possible to provide the alignment magnet 70D and the fixing magnet 71C having the same direction of magnetic pole as a matter of course.

Other Embodiments

Although the respective embodiments of the invention have been described, the basic configuration of the invention is not limited to those described above. For example, although the inner surface of the storage portion 19 of the case heads 20, 20A, 20B, or 20C on one side is defined as the alignment surface 50, and the side surface of the piezoelectric element 17 on the one side in the direction of parallel arrangement of the piezoelectric elements 17 is brought into abutment with the alignment surface 50. However, the invention is not limited thereto and the fixed substrate 35 may be brought into abutment with the alignment surface of the inner surface of the storage portion 19 of the case heads 20, 20A, 20B, or 20C. In other words, by bringing at least part of the piezoelectric element unit 18 into abutment with the alignment surface, the positioning between the piezoelectric elements 17 and the island portions 27 is achieved with a high degree of accuracy. Also, when bringing the fixed substrate 35 into abutment with the alignment surface of the inner surface of the storage portion 19 of the case head 20, for example, the inner surface of the case head 20 with which a surface intersecting the direction of parallel arrangement of the piezoelectric elements 17 comes into abutment may be defined as the alignment surface. In other words, the fixed substrate 35 may be adapted to be struck to the two intersecting inner surfaces of the storage portion 19 of the case head 20 by the magnet.

Figure 12:
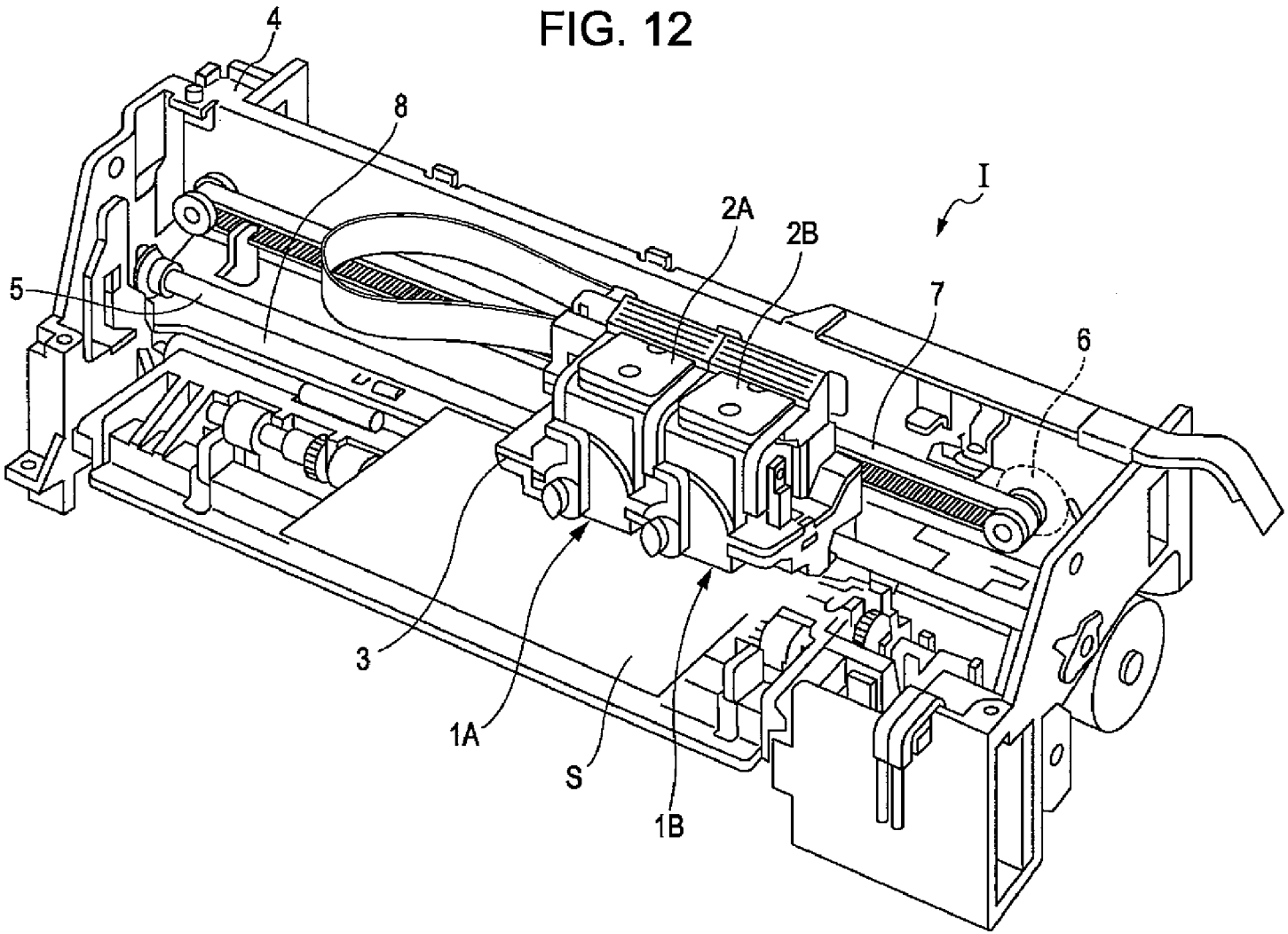
FIG. 12 is a schematic drawing showing an example of an ink-jet printing apparatus according to an embodiment.

The ink jet printhead in the respective embodiments described above constitutes part of the printhead unit having an ink flow channel which is in communication with ink cartridges or the like and is mounted on the ink-jet printing apparatus. FIG. 12 is a schematic drawing showing an example of the ink-jet printing apparatus.

As shown in FIG. 12, an ink-jet printing apparatus 1 includes printhead units 1A and 1B each having the ink jet printhead 10. The printhead units 1A and 1B have cartridges 2A and 2B which constitute demountably provided ink supply means, and a carriage 3 having the printhead units 1A and 1B is provided on a carriage shaft 5, which is attached to an apparatus body 4, so as to be movable in the axial direction. The printhead units 1A and 1B are, for example, adapted to discharge a black ink composition and a color ink composition, respectively.

Then, by a drive force from a drive motor 6 transmitted to the carriage 3 via a plurality of gears and a paper discharge tray 7, not shown, the carriage 3 having the printhead units 1A and 1B mounted thereon is moved along the carriage shaft 5. In contrast, a platen 8 is provided on the apparatus body 4 along the carriage shaft 5, and a printing sheet S as a printing medium such as paper supplied by a paper feed roller or the like, not shown, is wound around the platen 8 and is transported.

In the first embodiment described above, the ink jet printhead has been described as an example of the liquid ejecting head. However, the invention is intended to widely include the general liquid ejecting head, and can be applied to a method of manufacturing the liquid ejecting head which ejects liquid other than ink, as a matter of course. As other liquid ejecting head, there are various printheads used in image printing apparatuses such as printers, color material ejecting heads used for manufacturing color filters such as liquid displays, electrode material ejecting heads used for forming electrodes in organic EL displays, FEDs (field emission displays) or the like, and biological organic substance ejecting heads or the like used for manufacturing biochips.

The entire disclosure of Japanese Patent Application No. 2008-060321, filed Mar. 10, 2008 is incorporated by reference herein.

The entire disclosure of Japanese Patent Application No. 2008-271390, filed Oct. 21, 2008 is incorporated by reference herein.

What is claimed is:

1. A method of manufacturing a liquid ejecting head including a flow channel unit having pressure generating chambers in a parallel arrangement, a piezoelectric element unit having a plurality of piezoelectric elements and a fixed substrate, and a case head having a storage portion and a first magnet, the method comprising:

inserting positioning pins into positioning holes in the head case and the flow channel unit, wherein the positioning holes in the flow channel unit are formed on opposite ends and in the direction of the parallel arrangement of the pressure generating chambers;

joining the case head and the flow channel unit;

inserting the piezoelectric element unit into the storage portion of the case head while causing the fixed substrate to abut an alignment surface of the storage portion of the case head by a magnetic field of the first magnet; and joining the fixed substrate of the piezoelectric element unit, the case head, and the flow channel unit;

wherein the alignment surface is an inner surface of the storage portion of the case head;

wherein the first magnet is disposed on an exterior surface of the case head opposite the alignment surface of the storage portion of the case head; and wherein the fixed substrate is formed of a magnetic material.

2. The method of claim 1 further comprising:

providing a second magnet in the case head on a side opposite from the alignment surface in the direction of parallel arrangement of the pressure generating chambers, wherein a magnitude of the magnetic field of the first magnet at the fixed substrate is greater than a magnitude of a magnetic field of the second magnet at the fixed substrate.

3. A liquid ejecting head comprising:

a flow channel unit having pressure generating chambers which are in communication with nozzle openings for ejecting liquid;

a piezoelectric element unit including a piezoelectric element formed member provided in an area opposing the pressure generating chamber and formed with a plurality of piezoelectric elements and a fixed substrate configured to fix the piezoelectric element formed member hereto; and a case head being fixed to the flow channel unit and having a storage portion, the fixed substrate of the piezoelectric element unit being joined to an inner surface of the storage portion, wherein the piezoelectric element unit and the case head are fixed in a state in which at least part of a side surface of the piezoelectric element unit is in abutment with an alignment surface of an inner surface of the storage portion of the case head, and at least the side of the alignment surface of the fixed substrate is formed of a magnetic material;

wherein the case head includes an alignment magnet on an exterior surface of the case head opposite the alignment surface to exert a magnetic force to hold the side surface of the piezoelectric element unit in abutment with the alignment surface of the inner surface of the storage portion of the case head.

4. The liquid ejecting head according to claim 3, wherein the case head includes a fixing magnet on a side of the case head opposite from the alignment surface.

5. The liquid ejecting head according to claim 4, wherein the alignment magnet and the fixing magnet being provided so that a magnetic field of the alignment magnet with respect to the fixed substrate is larger than a magnetic field of the fixing magnet with respect to the fixed substrate.

6. The liquid ejecting head according to claim 4, wherein at least areas of the flow channel unit opposing the alignment magnet and the fixing magnet are formed of the magnetic material.

7. The liquid ejecting head according to claim 4, wherein the alignment magnet is arranged so as to have different magnetic poles on the side of the alignment surface and on the side opposite from the alignment surface in the direction of alignment, and the fixing magnet is arranged so as to have magnetic poles inverted from the alignment magnet in the direction of alignment.

8. The liquid ejecting head according to claim 4, wherein the alignment magnet and the fixing magnet are each arranged so as to have different magnetic poles on the side of the flow channel unit and on the side opposite from the flow channel unit.

9. The liquid ejecting head according to claim 4, wherein the alignment magnet has larger outer dimensions than the fixing magnet.

10. The liquid ejecting head according to claim 4, wherein the alignment magnet is provided at a position where the distance from the fixed substrate is narrower than the distance between the fixing magnet and the fixed substrate.

11. The liquid ejecting head according to claim 4, wherein the alignment magnet and the fixing magnet are provided between the fixed substrate and the flow channel unit.

12. The liquid ejecting head according to claim 3, wherein the magnetic material of the fixed substrate is invar.

13. The liquid ejecting head according to claim 3, wherein the entire fixed substrate is formed of the magnetic material.

14. The liquid ejecting head according to claim 3, wherein the case head is integrally molded with the magnets.

15. A liquid ejecting apparatus comprising the liquid ejecting head according to claim 3.

* * * * *